US007540224B2

(12) United States Patent
Wang

(10) Patent No.: US 7,540,224 B2
(45) Date of Patent: Jun. 2, 2009

(54) STRADDLE SAFETY PUSHER SYSTEM

(76) Inventor: Henry Wang, 660 Sumter Ct., Winter Springs, FL (US) 32708

( * ) Notice: Subject to any disclaimer, the term of this patent is extended or adjusted under 35 U.S.C. 154(b) by 210 days.

(21) Appl. No.: 11/381,559

(22) Filed: May 4, 2006

(65) Prior Publication Data

US 2006/0185485 A1 Aug. 24, 2006

Related U.S. Application Data

(63) Continuation-in-part of application No. 10/051,556, filed on Jan. 17, 2002, now Pat. No. 7,040,206.

(60) Provisional application No. 60/295,378, filed on Jun. 1, 2001.

(51) Int. Cl.
*B27B 25/00* (2006.01)

(52) U.S. Cl. ..... 83/436.2; 83/438; 83/437.2

(58) Field of Classification Search ..... 83/436.2, 83/438, 437.2, 431, 446, 437.1; 15/144.1, 15/145; 144/242, 216, 21; 269/156, 43
See application file for complete search history.

(56) References Cited

U.S. PATENT DOCUMENTS

| | | | |
|---|---|---|---|
| 751,121 | A | 2/1904 | Tidey |
| 1,032,278 | A | 7/1912 | England |
| 1,710,718 | A | 4/1929 | Stotz |
| 2,134,606 | A | 10/1938 | Hackworth et al. |
| 2,410,467 | A | 11/1946 | Valentine |

(Continued)

OTHER PUBLICATIONS

Micro Jig GRR-Ripper System & MJ Splitter Review, by Dean Bielanowski. OnlineToolReviews.com.

(Continued)

*Primary Examiner*—Boyer D Ashley
*Assistant Examiner*—Omar Flores-Sánchez
(74) *Attorney, Agent, or Firm*—David G. Maire; Beusse Wolter Sanks Mora & Maire, P.A.

(57) ABSTRACT

An adjustable pushing apparatus (50) for safely moving a work piece (22) past a cutting tool (16). The apparatus includes a body (52), a first leg (56), a second leg (58) and a moveable center leg (60) defining a leg side surface (74) and two adjustable-width tunnels (62, 64) through which a cutting tool may pass. A handle (54) is moveable along a top surface (82) of the body to provide a balance of forces on both the inside cut portion (24) and the outside cut portion (26) of the work piece. Non-slip work piece-contacting surfaces (76) provide positive engagement with the work piece. A balance support device (84) may be attached to either the first or second leg at a plurality of vertical heights to balance the apparatus when the work piece is too narrow to make contact with a work piece-contacting surface on both side of the cut line (C). In one embodiment (200) a bridge handle (202) is used to maintain balanced forces on both sides of the cut line. The handle portion (204) may be longitudinally angled relative to the cut line to provide a force vector keeping the pushing apparatus and work piece secured against the table saw fence (16). A trailing edge heel (212) may be attached to the pusher to minimize blowout of the rearmost edge of the work piece and to assist in applying additional feeding force to the work piece.

6 Claims, 16 Drawing Sheets

U.S. PATENT DOCUMENTS

| | | | | |
|---|---|---|---|---|
| 2,522,965 | A | | 9/1950 | Schaufelberger |
| 2,620,929 | A | | 12/1952 | Sportsman |
| 2,754,857 | A | | 7/1956 | Joslin |
| 2,839,100 | A | | 6/1958 | Valicenti |
| 2,895,513 | A | | 7/1959 | Cowley |
| 2,929,419 | A | | 3/1960 | Johnson |
| 3,934,341 | A | * | 1/1976 | Carlson ..... 30/287 |
| 4,001,903 | A | | 1/1977 | Hay |
| 4,066,250 | A | | 1/1978 | Campbell |
| D248,144 | S | | 6/1978 | Kreitz |
| 4,348,925 | A | | 9/1982 | Manweiler |
| 4,370,909 | A | | 2/1983 | Jennings |
| 4,432,263 | A | | 2/1984 | Kowalchuk |
| 4,476,757 | A | | 10/1984 | Morris |
| 4,485,711 | A | | 12/1984 | Schnell |
| D278,022 | S | | 3/1985 | Ash |
| D278,790 | S | | 5/1985 | Chaney et al. |
| 4,603,612 | A | | 8/1986 | Atkins |
| 5,016,509 | A | | 5/1991 | Stottman |
| 5,140,778 | A | | 8/1992 | Carruth |
| D342,658 | S | | 12/1993 | Gakhar et al. |
| 5,330,167 | A | | 7/1994 | Plumb |
| 5,341,711 | A | | 8/1994 | Stay, Jr. et al. |
| 5,662,019 | A | | 9/1997 | Denman |
| 5,678,467 | A | | 10/1997 | Aigner |
| 5,875,827 | A | | 3/1999 | Brutscher et al. |
| 5,894,777 | A | | 4/1999 | Sterling |
| 6,044,740 | A | | 4/2000 | Werkheiser |
| 6,098,972 | A | | 8/2000 | Klimach et al. |
| 6,135,521 | A | | 10/2000 | Wirth, Jr. et al. |
| 6,164,176 | A | | 12/2000 | Larsson |
| 6,196,283 | B1 | | 3/2001 | Hundegger |
| 6,382,608 | B1 | | 5/2002 | Michell |
| 6,491,073 | B1 | | 12/2002 | Essick |
| 6,732,623 | B1 | | 5/2004 | Jennings |

OTHER PUBLICATIONS

Save your fingers get a Grr-Ripper. Workbench Magazine, Aug. 2004, p. 90.

Wish List—GRR-Ripper: The Adjustable Block System. Tool Review by Carl Duguay. Canadian Woodworking Magazine, Dec./Jan. 2004, vol. 6, No. 6, p. 38.

Keep your hands protected. Traditional Woodworking, Sep. 2003, p. 47.

The Ultimate Push Block? Putting it to Use: More ways than you can count. Woodsmith, vol. 26, No. 156, p. 13. (www.Woodsmith.com).

* cited by examiner

STRADDLE SAFETY PUSHER SYSTEM

This application is a continuation-in-part and claims benefit of the Jan. 17, 2002 filing date of U.S. application Ser. No. 10/051,556 now U.S. Pat. No. 7,040,206, which in turn claims benefit of the Jun. 1, 2001, filing date of U.S. provisional patent application No. 60/295,378.

FIELD OF THE INVENTION

This invention relates generally to the field of woodworking tools, and more particularly to the field of accessories for feeding stock safely across a saw table.

BACKGROUND OF THE INVENTION

A table saw typically includes a flat, horizontally oriented table having an opening formed therein through which a top portion of a circular saw blade protrudes. The saw blade may be 10-12 inches in diameter, for example, and is motor driven to rotate at a speed of 3,000 revolutions per minute or more. A piece of stock material, typically wood, may be cut by moving it across the table to intersect the spinning saw blade. The height of the top of the saw blade above the table may be adjustable within predetermined limits in order to accommodate stock material of various thicknesses.

A fence is provided with a table saw to guide the movement of the stock in a direction parallel to the plane of the saw blade in order to ensure a straight cut and to avoid binding of the non-cutting portions of the saw blade within the stock material. A fence typically includes an elongated metal bar having a flat guide face oriented at a right angle with respect to the table and parallel to the plane of the saw blade. The distance between the fence guide face and the saw blade may be adjustable within predetermined limits in order to accommodate stock material and cut locations having various widths.

It is known to use a push stick to urge the stock material past the saw blade in order to keep the operators fingers at a safe distance from the dangerous rotating blade. The most simple push stick may be simply an elongated piece of excess stock material that is urged against the work piece. A more sophisticated push stick is described in U.S. Pat. No. 6,135,521 as including an ergonomically designed handle, two stepped portions for engagement with the work piece, and non-slip pads for better control. While the push stick of the '521 patent does provide a degree of protection for the one hand of the operator, it still requires the operator to touch the work piece with a second unprotected hand. Furthermore, this style of push stick can apply downward force against only the trailing edge portion of the work piece since it engages the rear edge of the work piece with a stepped portion of the stick. Applying downward force only against the trailing edge portion of the work piece may be inadequate to hold the stock material down. A long piece of stock material being urged into a saw blade with such a tool may be lifted away from the table by the lifting action of the rotating saw blade, thus creating a dangerous kick-back condition where the work piece is thrown upward toward the table saw operator.

U.S. Pat. No. 2,839,100 describes a woodworking accessory that engages the work piece along an extended length in order to keep the operator's hands away from the saw blade at all times. This device engages the stock material with a plurality of screws, thus causing undesirable damage to the work piece. While this device provides improved control of the work piece between the saw blade and the fence guide face, it does not provide any control for the severed portion of the work piece on the far side of the blade away from the fence, commonly called the outside cut material. While the outside cut material is often considered the scrap portion of the stock material, it nonetheless may present a danger to the operator if it is not properly restrained during the cutting operation.

U.S. Pat. No. 4,370,909 describes a hand guard for a table saw including a grooved underside adapted to rest on top of the work piece and a vertically moveable heel for engaging the rear edge of the work piece. Here, again, this tool engages the stock material only near its rear edge and is thus ineffective in restraining the leading edge portion of a long piece of stock material. Furthermore, the tool is narrow and must be positioned against the guide fence, so it is useful for removing only a small width of material from the work piece. The tool is designed to exert a pushing force against the work piece. It includes no means for positively forcing the work piece against the guide fence, thus necessitating the use of the operator's second unprotected hand for maintaining pressure against the fence as the work piece is moved past the saw blade.

DETAILED DESCRIPTION OF THE INVENTION

Figure 1:
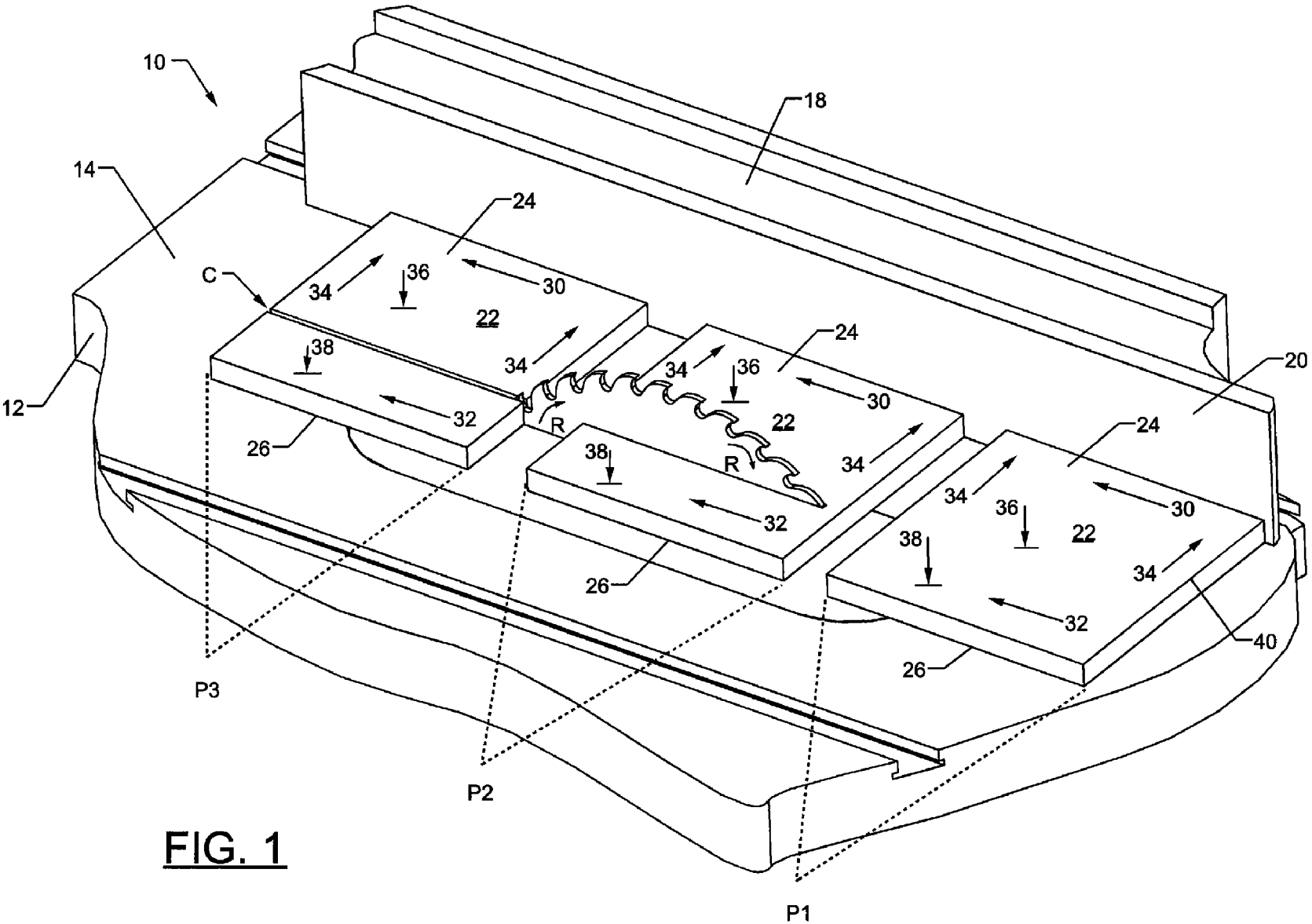
FIG. 1 is a perspective view of a table saw with a work piece in three positions to illustrate the forces exerted on the work piece during a sawing operation.

The inventor has analyzed the forces acting upon a work piece being moved over a table saw blade in order to identify the shortcomings of the prior art pusher designs and in order to evaluate the improved pusher apparatus described herein. FIG. 1 illustrates a table saw 10 including a table 12 with a flat horizontal surface 14 and a saw blade 16 having its top portion protruding above the table surface 14 through an opening formed in the table 12. A fence 18 connected to the table 12 includes a flat guide surface 20 oriented in a plane perpendicular to the table surface 14 and parallel to the saw blade 16. A work piece 22 is illustrated in three sequential positions P1, P2, P3 as it is moved past the saw blade 16. Position P1 illustrates the work piece 22 before it makes contact with the rotating saw blade 16. Position P2 illustrates the work piece 22 as it is being cut by the saw blade 16. Position P3 illustrates the work piece 22 as it is exiting the saw blade 16 after being cut into two pieces, commonly referred to as the inside cut portion 24 and the outside cut portion 26.

Arrows are used to illustrate the forces that should be exerted on the work piece 22 in order to ensure optimal control of the cutting process and to ensure the safety of the table saw operator. A pushing force is needed in a direction parallel to the direction of the cut C to force the work piece 22 past the saw blade 16. The pushing force should include separate components 30, 32 exerted on the inside cut portion 24 and outside cut portion 26, respectively. The rotation R of the saw blade 16 will create a force opposing pushing force 30, 32 proximate the leading edge of the saw blade 16 where the saw blade 16 is moving into the stock material.

Force 34 is utilized to keep the inside cut portion 24 in contact with the fence 18. Force 34 may have a zero or non-zero magnitude, but must not have a negative magnitude (i.e. in a direction toward the saw blade 16). Importantly, no force in the direction of force 34 should be exerted on the outside cut portion 26 in positions P2 and P3. Any such force acting on the outside cut portion 26 will cause the work piece 22 to engage the trailing portion of the saw blade 16 where it is traveling in an upward direction, thus causing binding of the saw blade 16, burning of the cut surface, and possible kickback of the work piece 22. Downward forces 36, 38 must be exerted on the inside cut portion 24 and outside cut portion 26, respectively. Downward forces 36, 38 must be of sufficient magnitude proximate the saw blade 16 to overcome the tendency of the rotating saw blade 16 to fling the work piece 22 upward. Movement of either the inside cut portion 24 or outside cut portion 26 in a direction that is not parallel to the guide surface 20 should be resisted.

Simple prior art pushers, such as the one described above in U.S. Pat. No. 6,135,521, provide a downward force 36 proximate the trailing edge 40 of the work piece 22 where they engage the trailing edge of the work piece 22. Depending upon the length of the work piece 22 and the length of the pusher, the magnitude of such a force may be insufficient proximate the saw blade 16, and the work piece 22 may be lifted away from the table surface 14. Accordingly, downward force 38 and pushing force 32 must be provided by the operator's unprotected hand with the device of U.S. Pat. No. 6,135,521. It is particularly difficult for an operator to provide pushing force 32 in a direction exactly parallel to the line C of the cut, especially due to the tall, narrow structure of the device. Should the operator exert any force in a direction toward the saw blade 16, the work piece 22 will bind with the saw blade 16 and cause burning and possible kick back. This is especially dangerous when making a bevel cut, since the forces generated between the saw blade 16 and the inside cut portion 24 can be very large.

In addition to damaging the top surface of the work piece, prior art pushers of the style of U.S. Pat. No. 2,839,100 also rely on the operator's unprotected hand for providing forces 32, 38. As described above, this is not only unsafe, but it is difficult for the operator to properly maintain such forces without exerting any force toward the fence.

The hand guard described in U.S. Pat. No. 4,370,909 includes a heel for generating pushing force 30, 32, and it provides a downward force onto the work piece, but it has no means for positively engaging the work piece 22 to provide force 34 for keeping the inside cut portion 24 in contact with the fence 18. Contact between the bottom surface of the hand guard and the top surface of the work piece is confined to a limited surface area, with the actual contact between these surfaces being further reduced by the inherent unevenness of the as-manufactured bottom surface of the hand guard. No provision is provided to prevent the work piece from slipping horizontally in relation to this prior art hand guard. Furthermore, depending upon the length of the work piece 22, the downward forces 36, 38 provided at the trailing edge portion of the work piece 22 by such a device may be insufficient to prevent kickback, since the device can only be place at the trailing edge of the work piece. The operator's unprotected second hand must be used to provide the missing forces for adequate control of the work piece 22.

Figure 2:
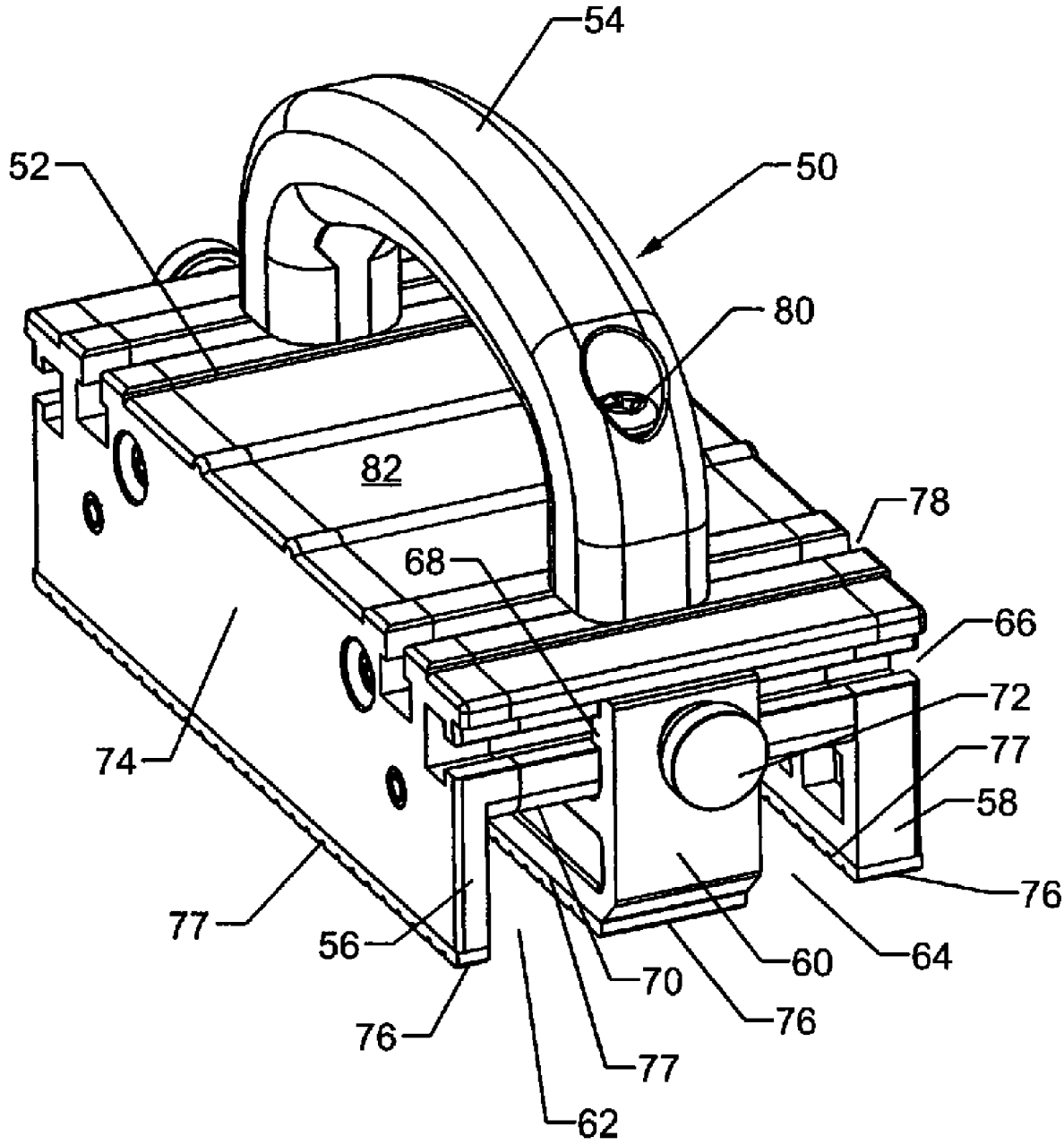
FIG. 2 is a perspective view of an apparatus for guiding a work piece through a cutting device in accordance with the present invention.

FIG. 2 illustrates an improved pusher apparatus 50 for guiding a work piece through a cutting device. The apparatus 50 includes a main body 52 to which other portions of the apparatus 50 are attached, either directly or indirectly. Other portions of the apparatus 50 include a handle 54, a first leg 56, a second leg 58 and a center leg 60. The apparatus 50 defines two tunnels 62, 64 through which a cutting device may pass when the apparatus 50 is used to push a piece of stock material. As will be described more fully below, the apparatus 50 may be assembled in several different configurations and may be used in several different manners to safely accomplish a variety of material-removal operations on a variety of sizes of material.

Apparatus 50 may be formed of component parts that can be attached or removed as desired. Body 52 is the structural base to which other components are attached, either directly or indirectly. Body 52 may be formed to include a slot or keyway 66 on opposed leading and trailing edges for receiving mating tongues or keys 68 formed on respective leading and trailing portions of center leg 60. Center leg 60 is assembled onto body 52 by sliding keys 68 into the opening slot of keyways 66 to position center leg 60 at a selected location along the underside 70 of body 52. The center leg 60 may be affixed at any selected location by tightening thumb screws 72 into mating nuts (not shown) located within the keyway 66, thereby drawing the keys 68 tight against the body 52. The location of center leg 60 defines the respective widths of tunnels 62,64.

First leg 56 and second leg 58 may be assembled onto the sides of body 52 by threading bolts through counter-bored holes in the respective leg into nuts embedded or otherwise retained in body 52. (hardware not shown in FIGURES) Each of the legs 56, 58 includes a flat side surface 74 adapted for abutting a flat guide surface of a saw table fence. Any mounting hardware exposed along the side surface 74 should be mounted flush or counter-bored below surface 74 so as not to interfere with the smooth movement of side surface 74 across a guide surface. Apparatus 50 may be assembled to include one or both of first leg 56 and second leg 58, depending upon the requirements of a particular operation. The legs 56, 58, 60 each extend away from the underside 70 of body 52 to form respective work piece-contacting surfaces 76. These work piece-contacting surfaces 76 are preferably non-slip surfaces, being formed from a material that does not easily slide over a work piece surface, for example rubber or a thermoplastic elastomer. The term non-slip is used herein with its common usage meaning that two surfaces will tend to stick together when a force is applied there between. The term non-slip need not imply a specific coefficient of friction, but rather is meant to include surfaces that are generally soft and adhering, such as rubber or other elastomers. The term non-slip as used herein excludes hard smooth surfaces such as metal or plastic having no special surface treatment, but may include such materials if treated to have a degree of roughness for imparting a non-slip property when forced against a work piece. A typical molded plastic part surface will have an inherent unevenness and hardness such that it will provide a slip surface when pressed against a work piece such as wood. A non-slip material may be molded into or may be attached to the bottom of the respective leg 56, 58 with an adhesive, or a non-slip material may be partially embedded into the bottom surface of the legs, or the material of the legs may be sufficiently roughened to be non-slip. It is preferred that the non-slip material used to form work piece-contacting surface 76 be slightly recessed from the first and second leg side surfaces 74 so as not to interfere with the smooth movement of side surface 74 across a fence guide surface. In one embodiment, the non-slip surface may be an elastomer having a durometer measurement of 35-40. The elastomer is sufficiently soft that it will deform to accommodate the inherent unevenness of a molded plastic surface, thereby further increasing its non-slip property. Grooves 77 may be formed in the surface 76 to accommodate a degree of unevenness of the leg and work piece surfaces and also to accommodate sawdust or other debris deposited on the work piece surface. The grooves may be formed to a depth of approximately 1/32 inch and spaced approximately ¼ inch apart in one embodiment.

Body 52 and legs 56, 58 may include keyways 78 for capturing hardware used to attach handle 54 and/or other accessories. Handle 54 may be moved to any selected position between first leg 56 and second leg 58, then locked into place by tightening bolts 80. Bolt 80 passed through a hole formed in handle 54 and is threaded into a nut disposed within the keyway 78. As will be described more fully below, the location of handle 54 with respect to body 52 may be selected to most advantageously locate the point of application of forces to be applied by an operators hand on the handle 54. Handle 54 may be aligned to be parallel to leg side surface 74 or it may be fixed at an askew position so that the longitudinal axis of the handle 54 is disposed at an angle to the cut line of the saw blade 16 and to a longitudinal axis of the apparatus 50.

The structural components of the apparatus 50 described above and below may be formed of plastic, metal, wood or other known materials of construction. In a preferred embodiment, the component parts are formed of structural foam injection molded plastic, with assembly hardware being formed of metal. Accidental contact between a cutting tool and a plastic apparatus part will not damage the cutting tool and may result in a lower risk of injury to an operator than would otherwise be the case if the apparatus part were formed of metal.

Figure 3:
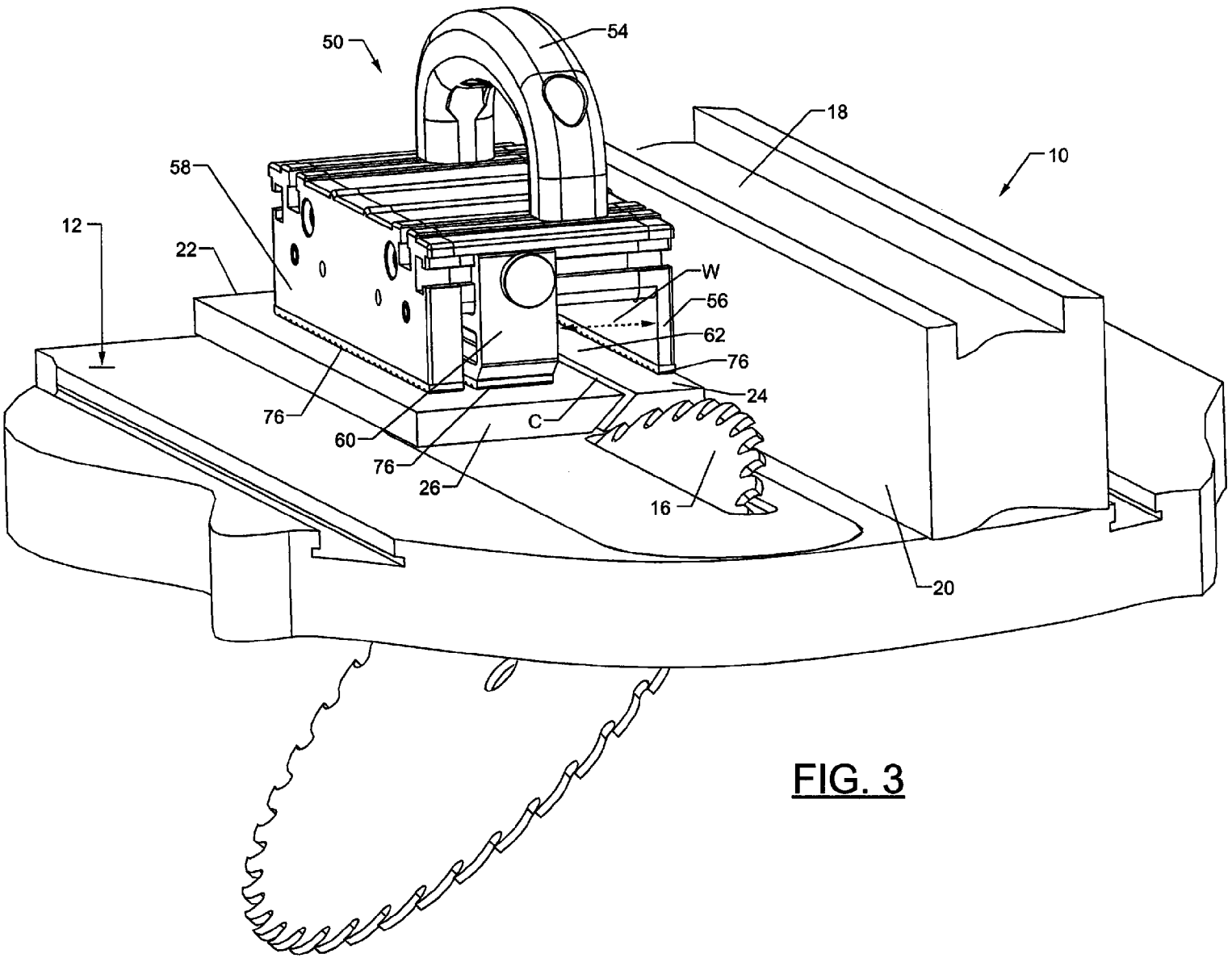
FIG. 3 is a perspective view of the apparatus of FIG. 2 being used to guide a piece of wood stock past a saw blade on a saw table.

The operation of apparatus 50 with a table saw 10 may be understood with reference made to FIG. 3. A work piece 22 of wood is positioned on a table 12, and is illustrated as having just been cut into an inside cut portion 24 and an outside cut portion 26 by saw blade 16. Apparatus 50 is positioned on the work piece 22 so that one of its tunnels 62 straddles the line of the cut C. Non-slip work piece-contacting surfaces 76 couple the apparatus 50 with the work piece 22 when the operator applies a downward force to handle 54. The operator is able to control the movement of work piece 22 past saw blade 16 by urging the handle 54 with a force vectored downward, toward fence guide surface 20, and forward along cut line C. The operator's hand is protected from the rotating saw blade 16 passing through tunnel 62 of apparatus 50. The side surface of first leg 56 provides guidance to maintain the movement of work piece 22 parallel to the desired line of cut C.

Apparatus 50 exerts all of the forces necessary for proper control of the work piece 22 as discussed above with reference to FIG. 1. The work piece-contacting surface 76 of first leg 56 provides downward force 36 and pushing force 30 on the inside cut portion 24. Apparatus 50 also exerts fence contacting 34 on inside cut portion 24 to keep the work piece 22 firmly against guide surface 20, without imparting any such force on outside cut portion 26. This is accomplished because apparatus 50 can move only parallel to guide surface 20, thus center and second leg work piece-contacting surfaces 76 can not urge outside cut portion 28 toward the line of the cut C. Accordingly, binding of the saw blade 16 and the resulting burning of the cut surface and dangerous kickback forces are avoided. The work piece-contacting surfaces 76 of second leg 58 and center leg 60 also provide downward force 38 and pushing force 32 on the outside cut portion 26, without the need for the operator to touch the work piece 22 with an unprotected hand. The apparatus 50 resists movement in any direction that is not parallel to the fence guide surface. Because apparatus 50 does not rely on a hook device engaging the edge of the work piece 22, it can be positioned closer to the leading edge of the work piece 22 to ensure that the downward forces exerted are sufficient to overcome any lifting force exerted by the saw blade 16 on the leading edge of the work piece 22.

Figure 4:
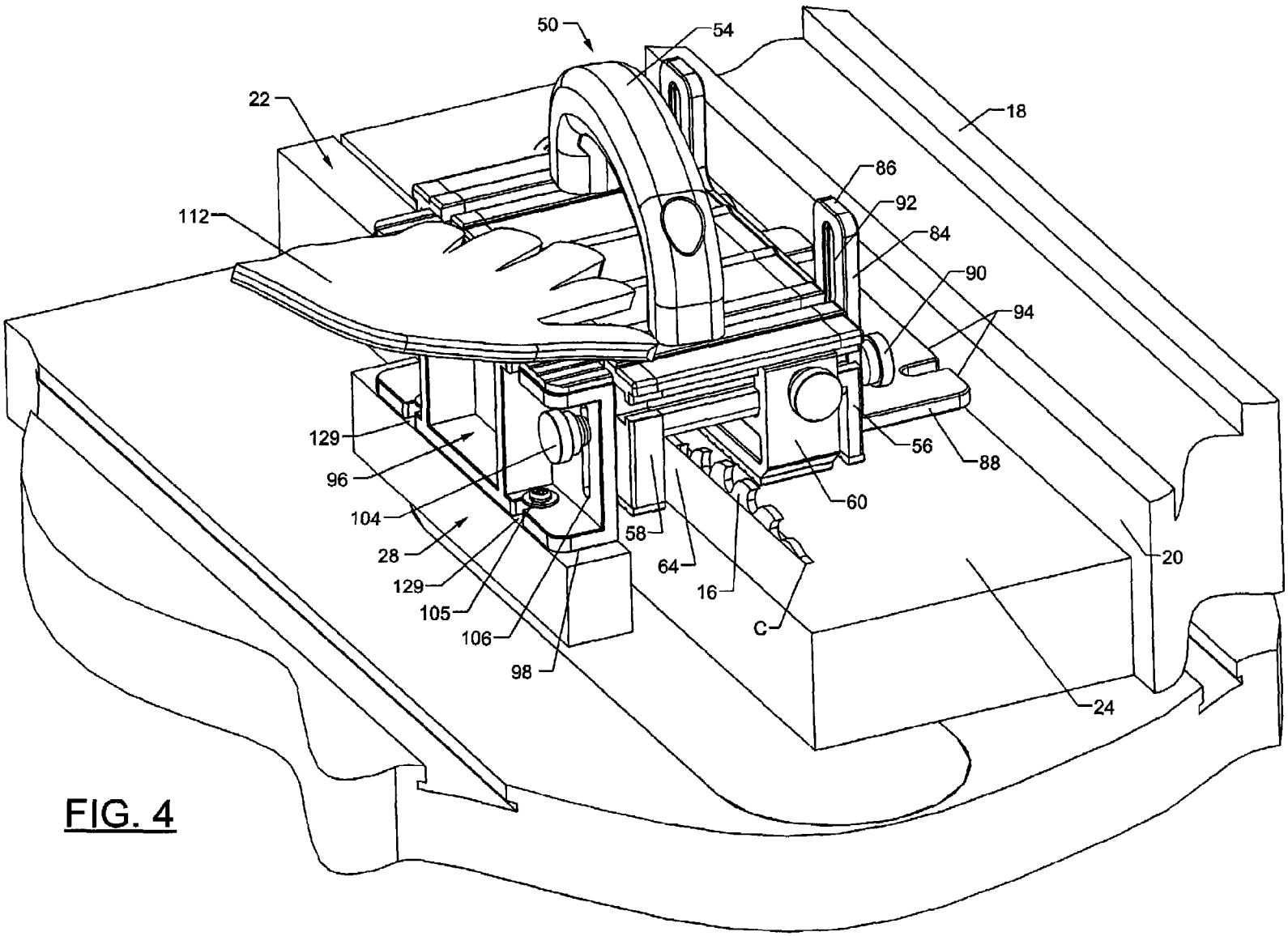
FIG. 4 is a perspective view of an apparatus for guiding a work piece through a cutting device and including a spacer for accommodating a relatively wide inside cut dimension and a balance device for accommodating a narrow outside cut dimension.

In the configuration of FIG. 3, center leg 60 is positioned against second leg 58 in order to maximize the width W of tunnel 62. This configuration is useful in this configuration because the table saw 10 is set up to make an angled cut in work piece 22, and thus the saw blade 16 protrudes from the work piece 22 toward first leg 56. Handle 54 is positioned generally over the line of the cut C to optimize the balance of the forces exerted upon the work piece 22. In this embodiment, first leg 56 has a width that is more narrow than the width of second leg 58, and first leg 56 is positioned to make contact with fence 18. In other configurations, it may be advantageous to position second leg 58 against fence 18, which can be accomplished by simply turning apparatus 50 in the opposite direction. For various cut dimensions, center leg 60 may be locked into any of a plurality of selected positions and the appropriate leg side surface 74 may be placed against guide surface 20 in order to locate cut line C within one of the tunnels 62, 64. Handle 54 may further be fixed in a position generally over the line of cut C or in any other position that facilitates a balance of forces and safe manipulation by the operator. It may be useful to align the front portion of the handle 54 to be somewhat closer to the fence 18 than is the rear portion of the handle 54, as illustrated in FIG. 4, so that the operator's action of pushing on the handle will naturally impart a force to the work piece in the direction toward the fence 18. In one embodiment, the top surface 82 (including top surfaces of legs 56, 58) may be approximately 3½ inches by 7 inches in size, the width of first leg 56 may be approximately ¼ inch, the width of second leg 58 may be approximately ½ inch, and the width of center leg 60 may be approximately 1 inch. Thus, a wide range of cut dimensions may be accommodated by appropriate movement of center leg 60 and handle 54, and with appropriate positioning of the apparatus 50 on table saw 10. One may appreciate that in other embodiments of this invention, the width of the tunnels 62, 64 may be made adjustable by providing a body having an adjustable width, or by providing one or both of the legs to have an adjustable width.

There may be certain stock materials and cut dimensions that are beyond the range of adjustment of a particular embodiment of body 52 and legs 56, 58, 60. One such situation is illustrated in FIG. 4, where a relatively wide inside cut portion 24 is desired. Even with center leg 60 moved all the way against first leg 56 or second leg 58, the position of tunnel 64 would not be properly over cut line C if the side surface of either first or second leg 56, 58 were placed directly against guide surface 20. To position apparatus 50 for this configuration, a balance support 84 is attached to the side surface 74 of first leg 56. Balance support 84 is illustrated in FIG. 4 as an L-shaped member having a generally vertical portion 86 connected to a generally horizontal portion 88. Balance support 84 is removeably connected to first leg 56 by thumb screw 90 which extends through an elongated slot 92 formed in spacer vertical portion 86 and is threaded into a nut (not shown) captured below the side surface 74 of first leg 56. Spacer horizontal portion 88 extends away from first leg 56 to form a spacer side surface 94 that is abutted against guide surface 20 to properly locate tunnel 64 over saw blade 16.

Figure 5:
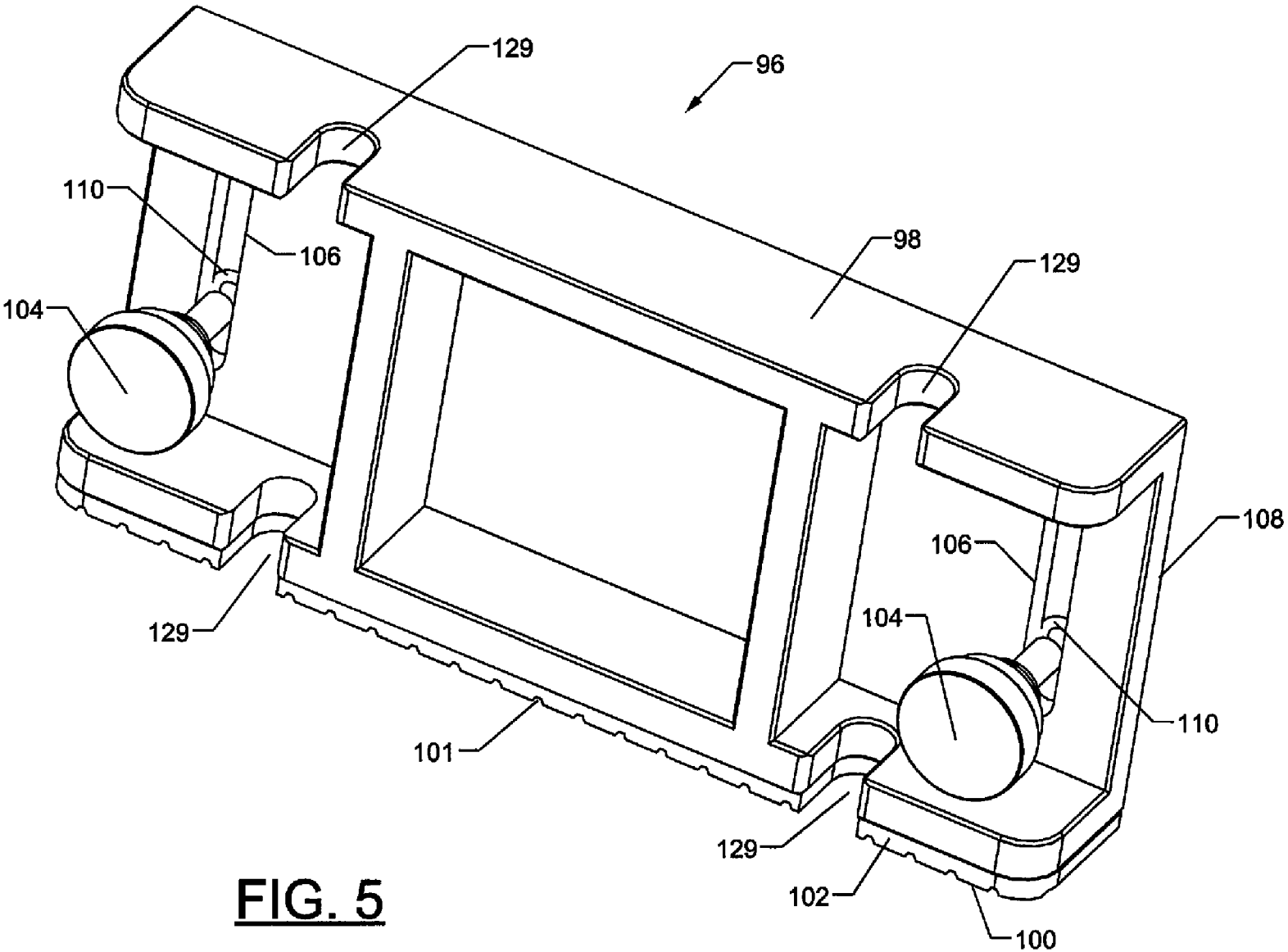
FIG. 5 is a perspective view of an embodiment of a spacer for use with the apparatus of FIG. 2.

Another embodiment of a spacer is illustrated in FIG. 5. Spacer 96 is formed to have a generally rectangular shape with a first work piece-engaging surface 98 opposed a second work piece-engaging surface 100. First work piece-engaging surface 98 may be plastic or other slip surface material, while opposed second work piece-engaging surface 100 may be a non-slip surface, such as is formed by an integrally molded layer 102 of rubber or other elastomer. A plurality of grooves 101 may be formed in the surface 100, as described above with respect to the grooves 77 of FIG. 2. Spacer 96 is attached to the side surface 74 of either the first leg 56 or second leg 58 of the apparatus 50 of FIG. 2 by tightening thumbscrews 104 which pass through slots 106 formed in a spacer rear wall 108. Thumbscrews 104 may be retained within slots 106 when the spacer 96 is not attached to an apparatus 50 by providing rubber washers 110 over the threaded bolt portion of thumbscrews 104. The rubber washers 110 fit into a recessed counter-bore (not illustrated) formed either in the rear wall 108 of spacer 96 or in the side surface 74 of the attaching leg 56, 58. Advantageously, spacer 96 may be attached to an apparatus 50 with either first work piece-engaging surface 98 or second work piece-engaging surface 100 facing downward to form a spacer bottom surface to engage an underlying surface.

Figure 6:
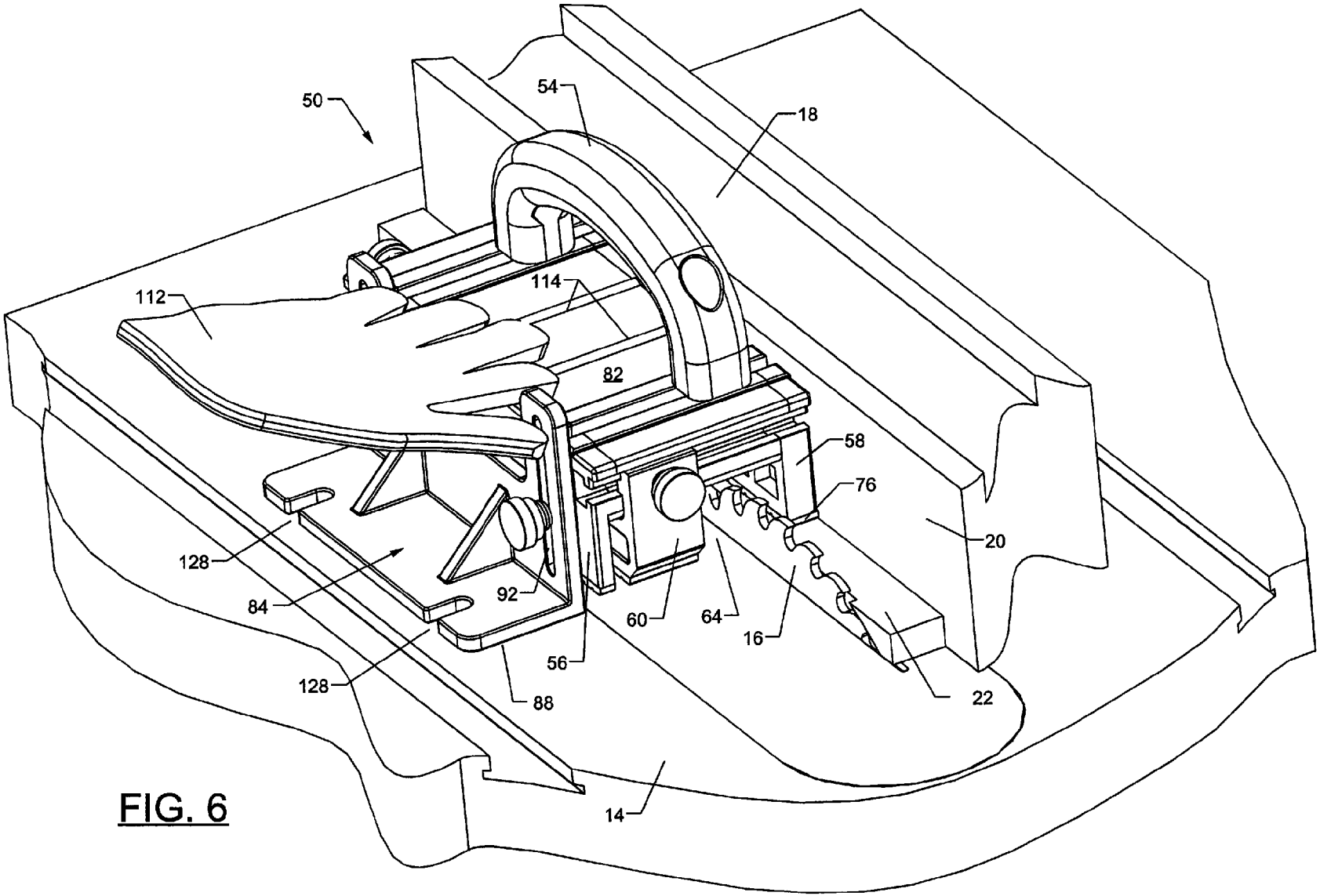
FIG. 6 is a perspective view of the apparatus of FIG. 4 being used in an opposite direction with one spacer removed on a narrow piece of stock material.

By providing vertically oriented slots 92, 106 for the passage of thumbscrews 90, 104, a balance support 84 or spacer 96 may be attached (directly or indirectly via first or second leg) to body 52 at any of a plurality of vertical heights. This feature may be used advantageously when the width of the work piece 22 is too narrow to properly engage both sides of tunnel 64 as illustrated in FIG. 6. In this configuration, a very narrow strip of material is being removed from work piece 22 by saw blade 16. Second leg 58 is placed onto the top of the work piece 22 and urged against the fence 18. The necessary downward, forward and fence-ward forces are applied to the inside cut portion of the work piece 22 through second leg non-slip work piece-contacting surface 76. Center leg 60 and handle 54 are positioned so that the saw blade 16 is approximately centered within tunnel 64 and under handle 54. However, no portion of work piece 22 extends under second leg 60 or first leg 56 to keep apparatus 50 level. In this configuration, balance support 84 is attached to first leg 56 in a vertical position that extends the bottom support surface of the balance support horizontal portion 88 to an elevation that is below the plane containing work piece-contacting surfaces 76 to make contact with the table surface 14. In this configuration, the balance support 84 acts as a balance support device to keep the apparatus 50 level as the work piece 22 is moved past the saw blade 16. In one embodiment, slots 92 provide sufficient vertical movement of balance support 84 to accommodate stock material having a thickness of about 2 inches. For thicker stock material, an additional piece of spacer material 28, as shown in FIG. 4, can be attached under the balance support 84, spacer 96 to further extend a bottom surface of the spacer downward. Such additional piece of material 28 may be connected by passing connectors 105 through slots 128, 129 and into the spacer material 28.

Apparatus 50 protects the operator's first hand (not illustrated) as it is placed on the handle 54. The operator may place a second hand 112 on the balance support 84 and/or on the body 52 to provide additional force against apparatus 50. The body top surface 82 may include ribs 114 or other non-slip structures or materials to provide additional gripping action for the operator's second hand 112.

Figure 7:
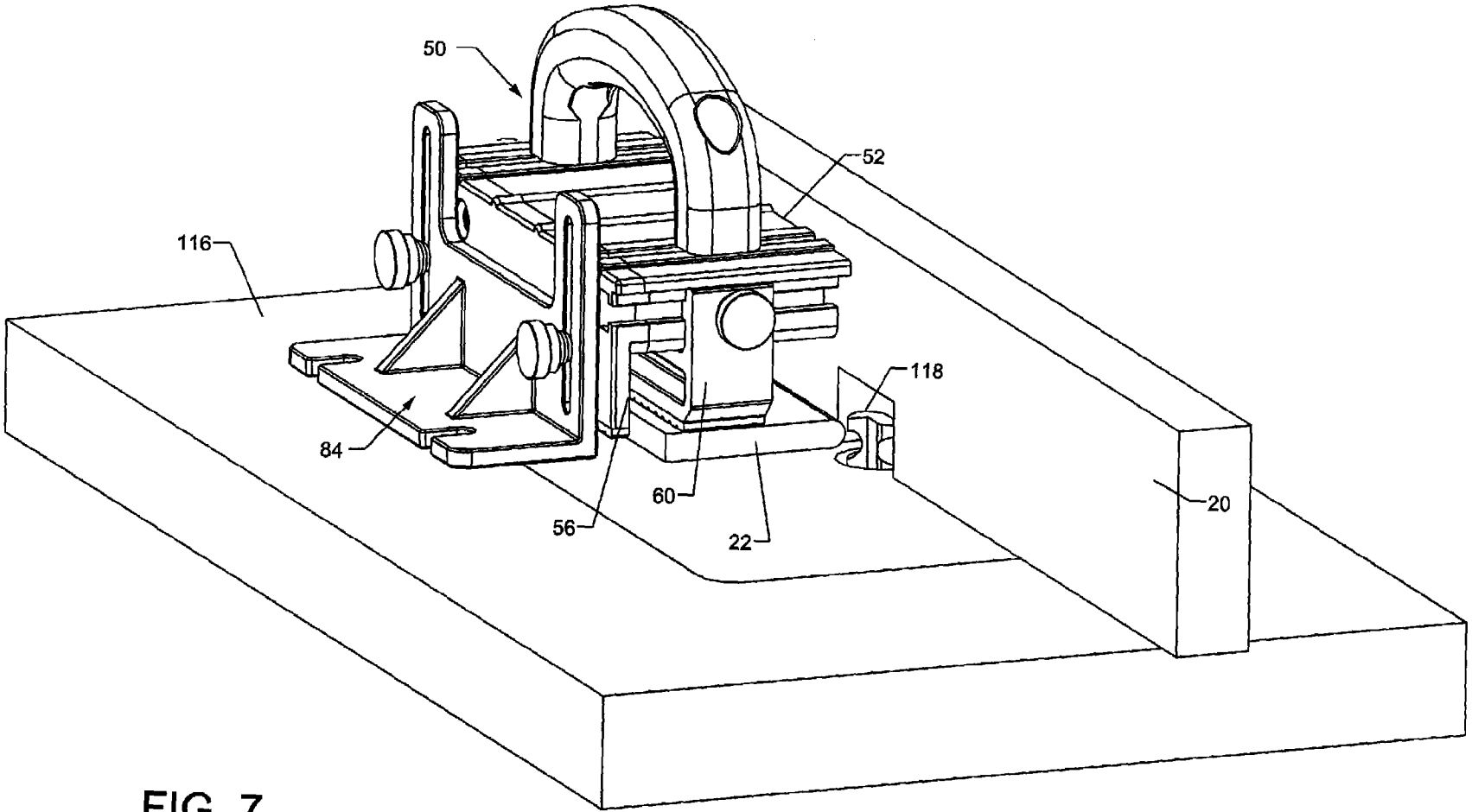
FIG. 7 is a perspective view of an apparatus for guiding a work piece through an edge profile cutting device in accordance with the present invention.

FIG. 7 illustrates the use of apparatus 50 with the first leg 56 and center leg 60 in place, but with the second leg 58 removed. This configuration is especially useful when the apparatus 50 is used on a router table 116 for making an edge profile cut on work piece 22. The side of body 52 is formed to be a surface for sliding along the guide surface 20. Center leg 60 provides contact with the work piece 22 to move it past cutter 118. Removal of the second leg 58 avoids contact between the apparatus 50 and the cutter 118. The balance support 84 may be used as a support for keeping the apparatus 50 level during the edge profile operation.

Figure 8:
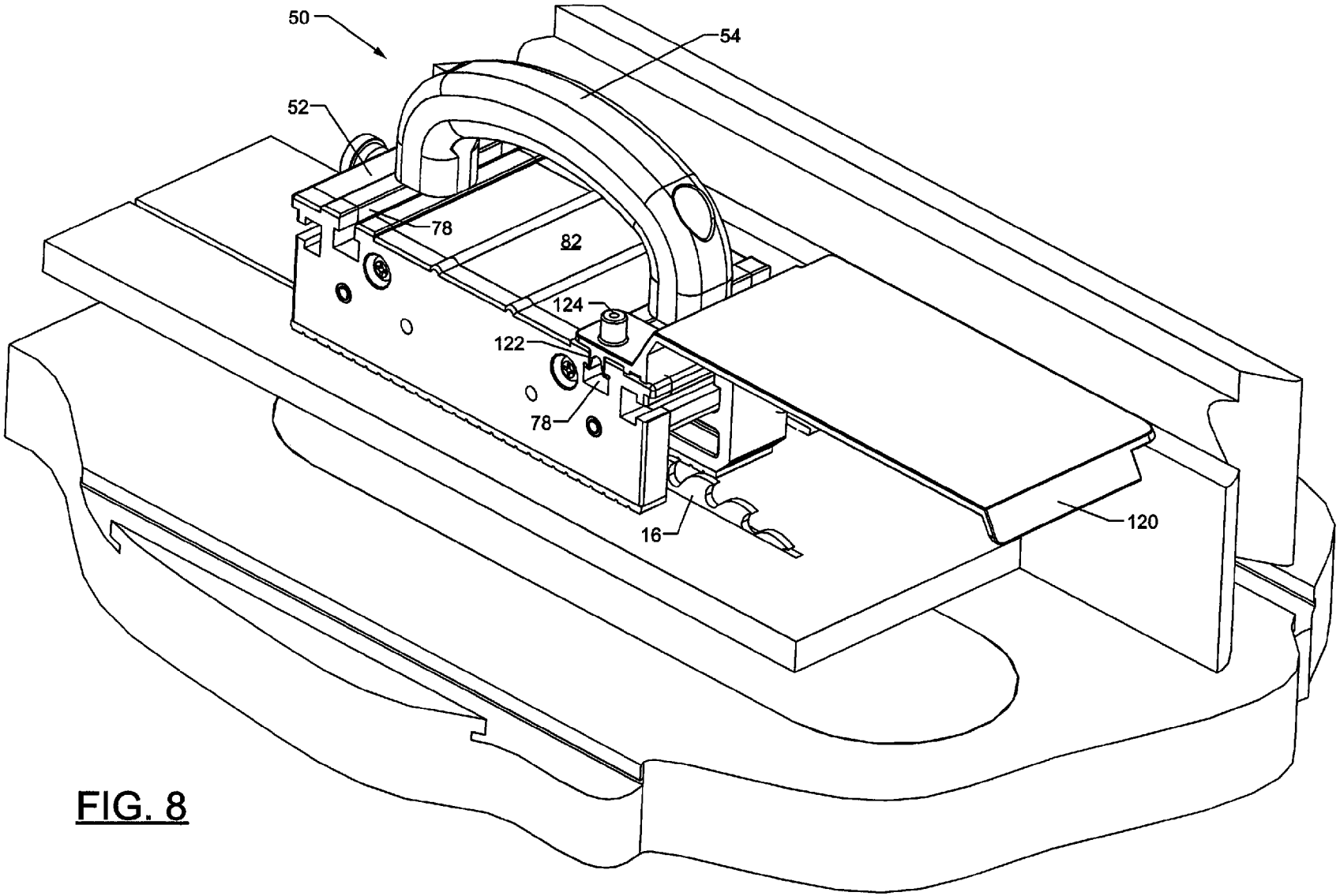
FIG. 8 is a perspective view of the apparatus of FIG. 2 being used with an accessory dust shield.

Another accessory that may be used with apparatus 50 is a shield such as dust shield 120, as illustrated in FIG. 8. As apparatus 50 is moved past the saw blade 16, sawdust generated by the cutting operation may be blown away from the blade 16 toward an operator's face. While eye protection is recommended when using any power tool, the cloud of sawdust may still be an unpleasant distraction for the operator. Dust shield 120 is provided with a connector such as key 122 formed to slide into one of the keyways 78 used to attach handle 54. Dust shield 120 may be formed of a polycarbonate material, and key 122 may therefore have a spring property that maintains a tight, yet moveable fit in keyway 78. The dust shield 120 may be supported from this single key 122 and allowed to rest along its leading edge against the top surface 82 of body 52. A small gripping knob 124 may be provided to facilitate the sliding of key 122 into and out of keyway 78. Although primarily functioning to direct sawdust away from an operator's face, dust shield 120 also provides some additional protection for the operator's forearm as the apparatus 50 is moved past the saw blade 16.

Figure 9:
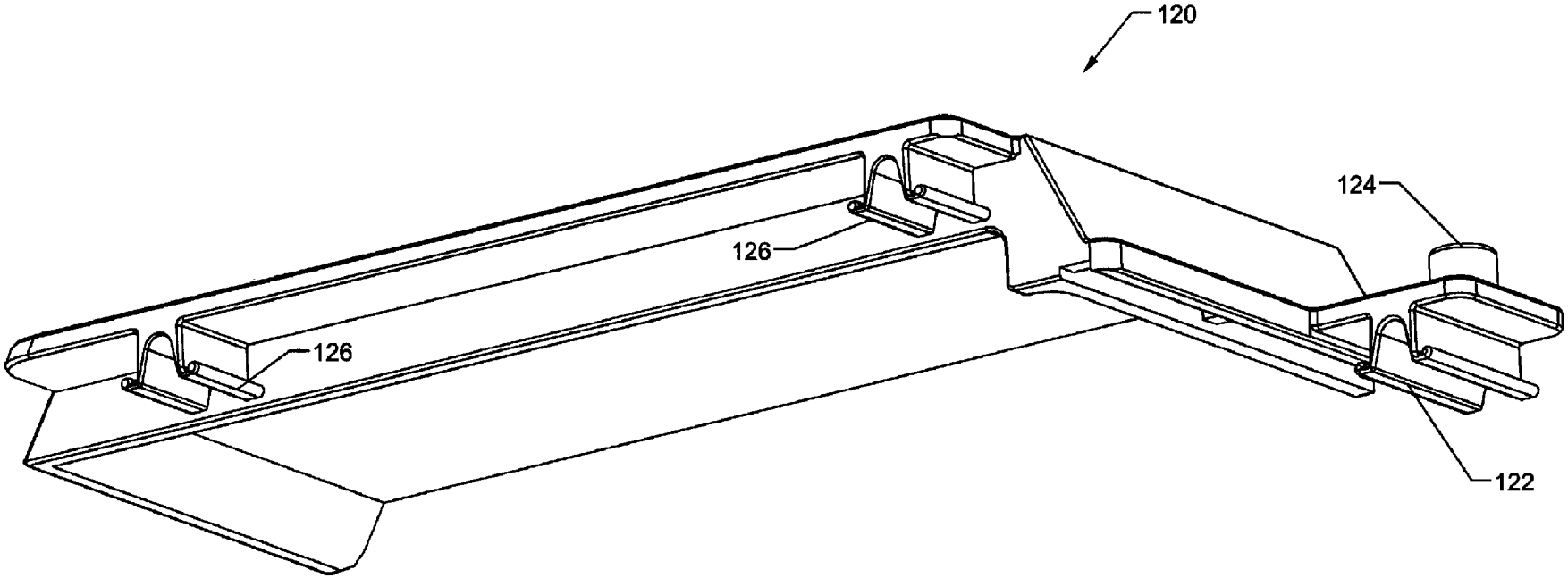
FIG. 9 is a perspective view showing an underside of the dust shield of FIG. 8.

Dust shield 120 may be provided with an alternative connector, such as a second set of keys 126 on its underside, as illustrated in FIG. 9. These keys 126 are used to secure dust shield 120 in an alternative position relative to the body 52, along side either the first leg 56 or second leg 58, by inserting keys 126 into the keyways 78 used for handle 54. This location of dust shield 120 may be especially useful when using apparatus 50 to guide a work piece 22 into a cutter 118 on a router table 116 that does not include a fence 18. In this configuration, the dust shield 120 would extend away from body 52 and over cutter 118, and should therefore be formed of a clear material to allow the operator to view the edge cutting operation through the dust shield 120.

Balance support 84, spacer 96 may be provided with open-ended slots 128, 129 as illustrated in FIGS. 5 and 6. These slots may be used to removeably attach additional accessories, such as stabilizing plate 130 illustrated in FIG. 10. Stabilizing plate 130 is a generally flat plate of material having two parallel horizontal slots 132 formed therein for receiving respective bolts 134 and wing nuts 136. The heads of bolts 134 (not shown) are captured in a counter bore formed on the underside of stabilizing plate 130 so that the bolts do not rotate as the wing nuts are tightened. Stabilizing plate 130 is installed as a horizontal extension under balance support 84 and under first leg 56 so that the plate 130 can be adjusted horizontally with respect to balance support 84. Shoulder washers 138 installed on the bolts 134 are sized to fit snugly into open-ended slots 128 so that the plate 130 does not fall away from balance support 84 as it is being adjusted horizontally and before wing nuts 136 are tightened. The position of bolts 134 within slots 132 is adjusted so that an edge 140 of the stabilizing plate 130 is moved to one of a plurality of horizontal positions to abut an edge of work piece 22, thereby providing additional support for the safe movement of the work piece 22. This feature may be especially useful when the work piece is somewhat warped and does not rest evenly against the fence 18. When cutting such a warped work piece, the width of the inside cut portion of the work piece varies along its length after the cut is completed because the fence-side edge of the work piece was not held uniformly against the fence as the work piece was moved through the saw blade. The stabilizer plate 130 allows pusher apparatus 50 may be set up so that the blade-side edge of the stabilizer plate is urged against the outside cut portion of the work piece as the fence-side edge of the apparatus 50 is abutted against the fence. In this manner, the user can apply force in a downward/forward/fenceward direction to urge the work piece through the saw blade 16. The fenceward vector of the force will reverse any warp in the work piece and flatten the edge of the work piece against the fence, thereby ensuring an even width to the inside cut portion of the work piece.

A trailing edge hook 142 may be used to provide an additional means for conveying a pushing force against the work piece 22. Such a hook 142 may be provided on only one edge 140 of the stabilizing plate 130 so that the stabilizing plate 130 may be positioned proximate an edge of a work piece 22 or remote from any edge of the work piece 22, as illustrated by the two different configurations of FIG. 10.

Figure 10:
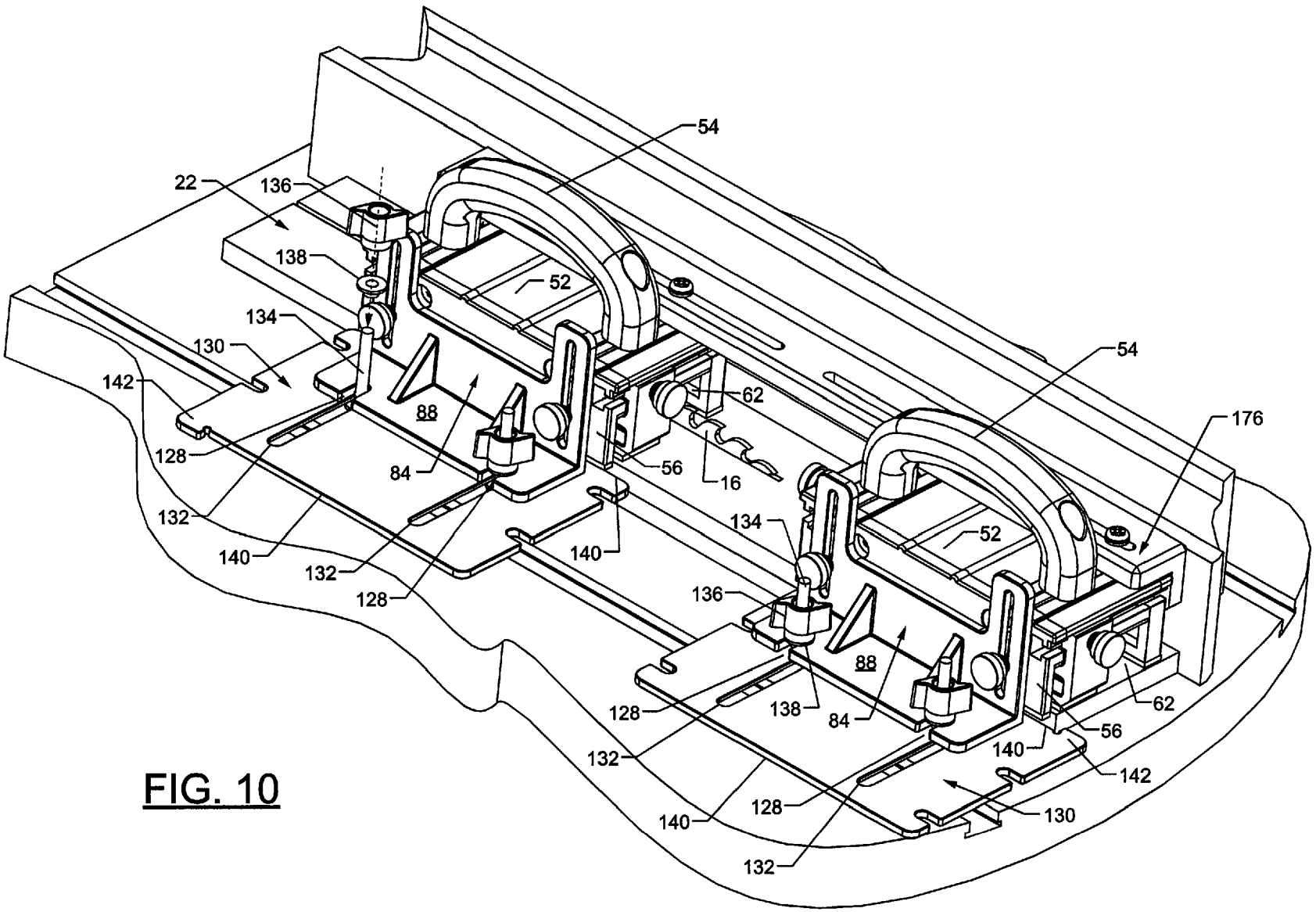
FIG. 10 is a perspective view of an apparatus for guiding a relatively long work piece through a cutting device.

FIG. 10 also illustrates how two individual structures may be attached together to form an apparatus for guiding a long piece of stock material through a cutting device. A bridge 176 may be connected between two respective bodies 52 to align respective tunnels 62 along a single cut line so that saw blade 16 passes first through one of the tunnels 62 then through the second tunnel 62. In this manner, the operator can apply the necessary forces to the work piece 22 as the cut progresses simply by using one hand on each respective handle 54 or by moving hands from one handle 54 to the next as the cut progresses. Any number of bodies 52 may be connected in this manner to accommodate any length work piece 22.

In lieu of using a bridge 176, a long work piece may be "walked" through the saw blade 16 by using two pusher apparatuses 50 (one in each hand) and alternately moving one apparatus 50 then the other to a position behind the saw blade 16 as the work piece is moved through the saw blade. During each "step" of this process, control is maintained over the work piece with the other apparatus 50 that is not being stepped. The use of a stabilizer plate 130 during such a process may be helpful in order to allow for easy, fast and secure positioning of the pusher apparatus 50 against the work piece.

Figure 11:
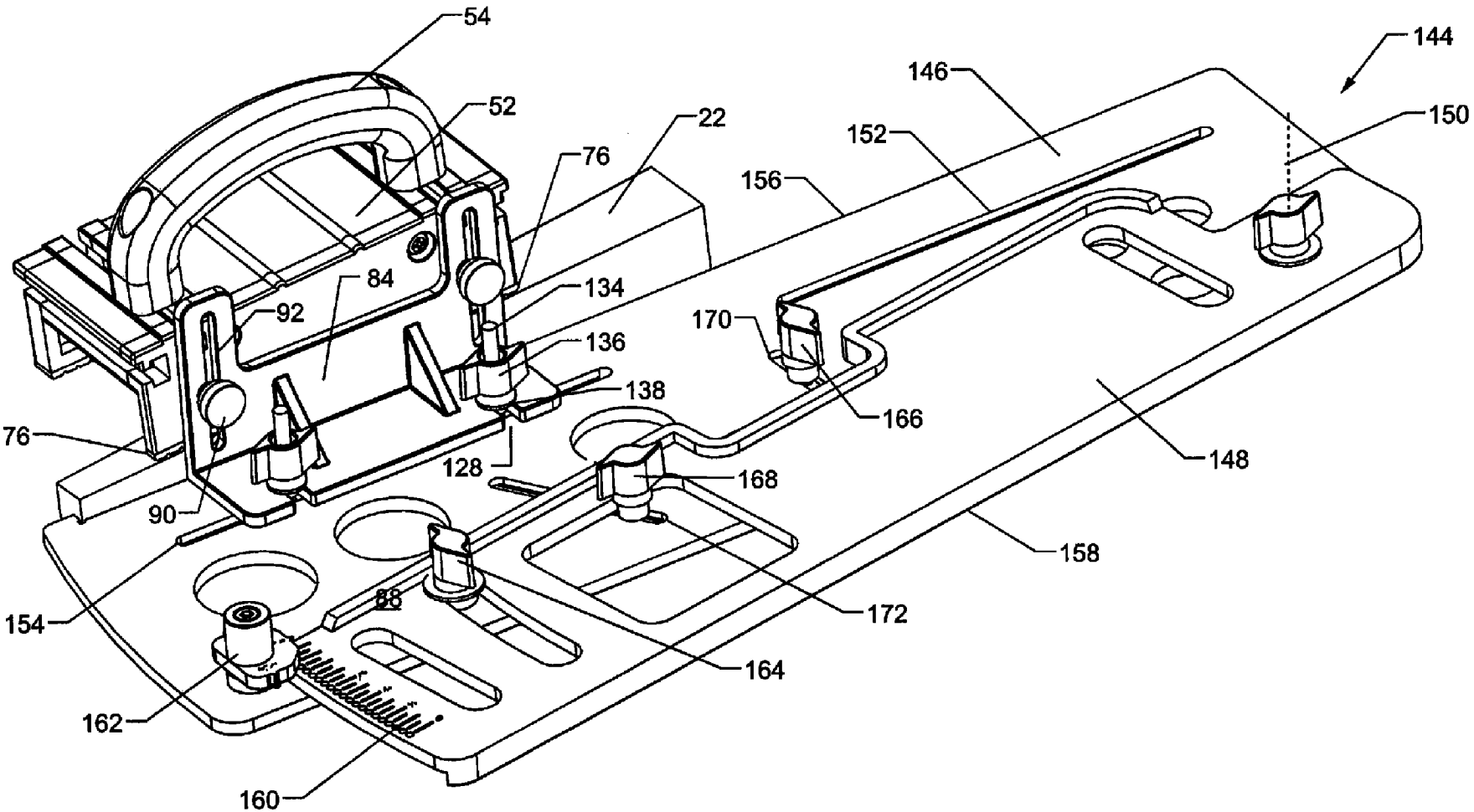
FIG. 11 is a perspective view of a tapering accessory for use with the apparatus of FIG. 2 as seen in a tapering configuration.
Figure 12:
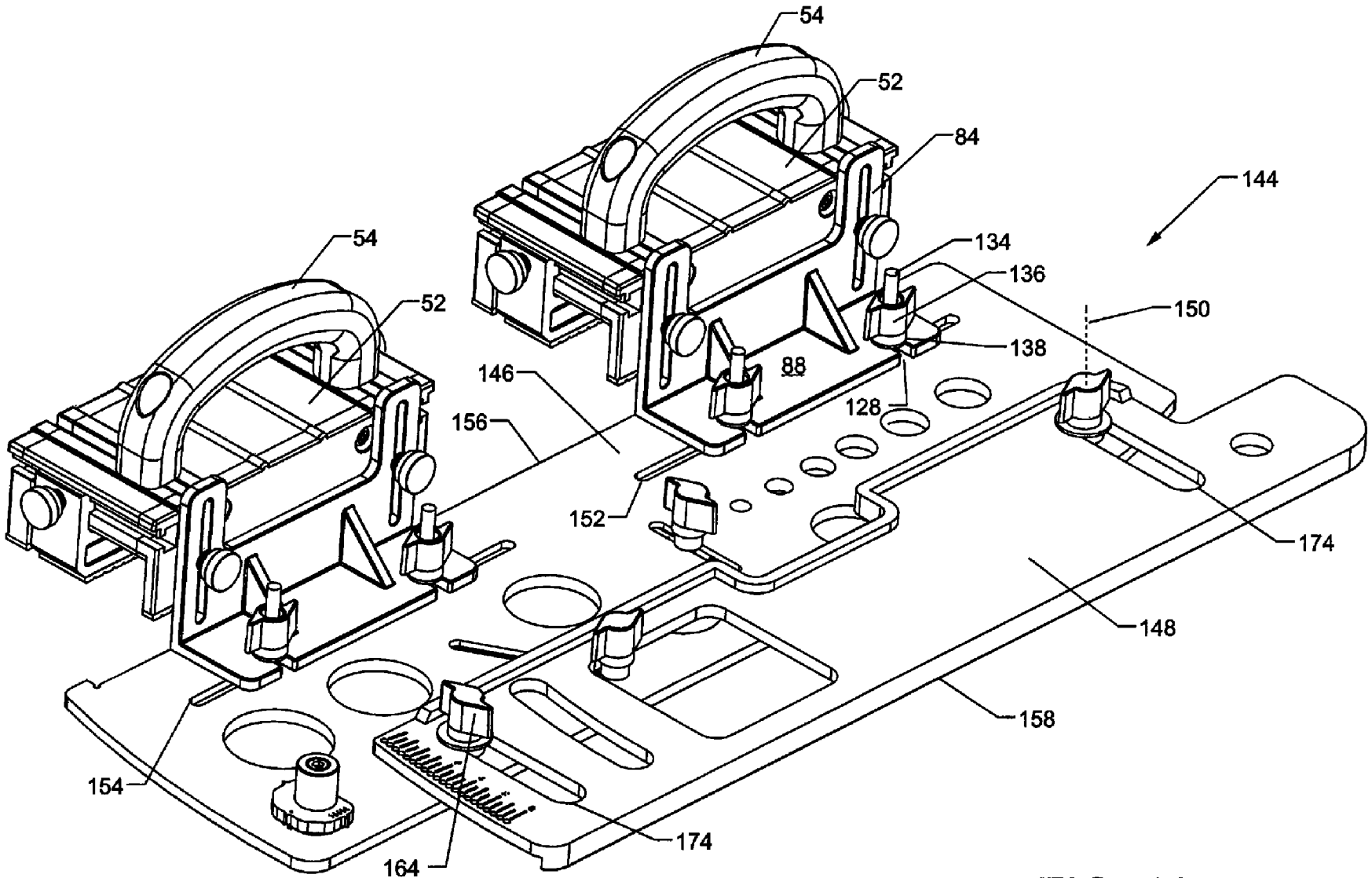
FIG. 12 is a perspective view of a tapering accessory for use with the apparatus of FIG. 2 as seen in a jointing configuration.

FIGS. 11 and 12 illustrate a tapering device 144 that may be attached as part of apparatus 50 for making saw cuts along a line that is not parallel to an opposed edge of the stock material. Such taper cuts are known to be useful for making tapered table legs, for example. Tapering device 144 includes a bottom plate 146 and a top plate 148 pivotally joined at pivot axis 150. Bottom plate 146 is attached to balance support 84 by bolts 134 and wing nuts 136 passing through slots 152, 154, with first edge 156 extending under balance support 84 to make parallel contact with an edge of the work piece 22. Top plate 148 may be moved such that second edge 158 forms a selected angle with respect to first edge 156 and with respect to the edge of work piece 22. The angle there between may be indicated by the relative location of markings 160. Once top plate 148 is positioned in such a tapering configuration to a selected angle, locking knob 164 is tightened to fix the two plates 146, 148 in their relative positions. The apparatus 50 is pushed downward to engage a work piece 22 with the second edge 158 abutting a table saw fence 18, thus creating a cut line C that is angled with respect to the edge of the work piece 22 that abuts first edge 156. Note that when making such a cut, the saw blade 16 will pass at an angle through selected tunnel 62, 64. Accordingly, it may be desirable to make the selected tunnel 62, 64 as wide as possible, including the possibility of using apparatus 50 with at least one of the legs 56, 58, 60 removed. FIG. 11 illustrates apparatus 50 with only first leg 56 and second leg 58 installed.

When making a taper cut on two opposed sides of the same piece of stock material, one may appreciate that the set-up for the second cut must include consideration of the taper that was previously made on the first side of the material. Thus, tapering device 144 may be set to 2° for a first cut, then 4° for a second cut on the opposed side of the same piece of material. When making multiple such pieces, it may be necessary to repeatedly change the setting of tapering device 144 from one angle to another. To facilitate such an operation, two memory stops 166, 168 are provided on bottom plate 146. A first angle is selected and first memory stop 166 is moved in slot 170 to abut top plate 148 and locked into position. A second, greater angle is then selected and second memory stop 168 is moved in slot 172 to abut top plate 148 and locked into position. The device 144 may then be quickly switched between the first angle and the second angle by simply loosening locking knob 164, sliding top plate 148 until it abuts either first memory stop 166 or second memory stop 168, then again tightening locking knob 164.

FIG. 11 shows work piece 22 as already being tapered on all four surfaces so the height of the work piece 22 varies along the line of the cut. Bottom plate 146 rests upon the horizontal table surface 14 (not shown in this view) and work piece contacting surface 76 rests upon the non-horizontal top surface of work piece 22. To accommodate this configuration, the position of the two thumbscrews 90 will be located at different vertical elevations within respective slots 92 to position body 52 at an angle with respect to horizontal. Thus, balance support 84 serves to keep work piece contacting surface 76 parallel to and in full contact with the work piece 22.

Tapering device 144 is illustrated in FIG. 12 in a parallel configuration where it may be used as part of apparatus 50 as a jointing device. Top plate 148 is moved to a new position on bottom plate 146 so that bolts and wing nuts that were used in the configuration of FIG. 11 at pivot axis 150 and locking knob 164 are now located within respective elongated straight slots 174. In this manner, second edge 158 may be located at a plurality of selected distances remote from and parallel to first edge 156. Second edge 158 may thus extend past an uneven edge of a work piece 22 when apparatus 50 is held against the work piece 22 so that a straight jointing cut may be made on the work piece 22.

Tapering device 144 may also be used as a bridge for cutting long pieces of stock material. This can be accomplished by connecting a first body 52 to tapering device 144 via balance support 84 at slot 154 and connecting a second body 52 to tapering device 144 at slot 152, in a manner similar to the way that stabilizing plates 130 are attached in FIG. 10. In this configuration, tapering device 144 provides a second function as a bridge. The operator may then place one hand on each respective handle 54 to engage a long work piece with the entire assembly moving as a single apparatus.

Figure 13:
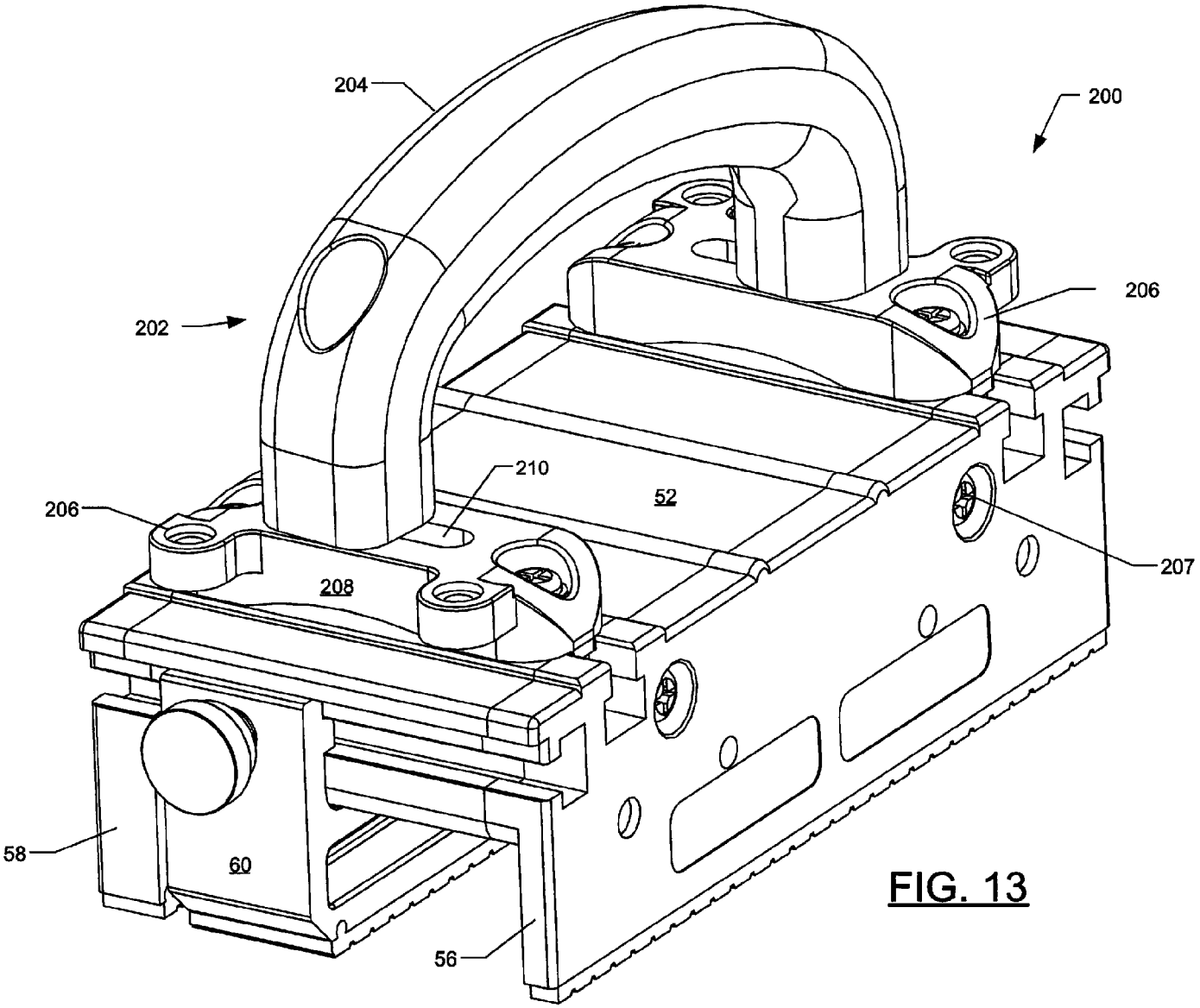
FIG. 13 is a perspective view of an apparatus for guiding a work piece through a table saw including a bridge handle design.

FIG. 13 illustrates another embodiment of a pusher apparatus 200 for guiding a work piece through a table saw. Apparatus 200 is similar to apparatus 50 described above, but with the addition of a bridge handle 202. Apparatus 200 includes a body 52; an inside cut leg 56 extending from the body for making frictional contact with the inside cut portion of a work piece; an outside cut leg 58 extending from the body for making frictional contact with the outside cut portion of a work piece; and optionally a center leg 60 adjustably attached to the body 52 and extending from the body 52 to make frictional contact with the work piece on one selected side of the cut line. Apparatus 200 may be used with the various attachments described above, such as a balance support 84 illustrated in FIG. 6. One may appreciate that the two legs 56, 58 may have different widths and may reversibly be used for controlling the inside cut portion or the outside cut portion respectively when the apparatus is built to be reversible with respect to a longitudinal axis parallel to the cut line. The legs 56, 58 may be joined to the body 52 with fasteners such as screws 207, so that in optional configurations, either one of legs 56, 58 may be removed for use of the apparatus 200 in a two-legged configuration. The two-legged configuration may be useful when used on a router table 166, as illustrated in FIG. 7 for pusher apparatus 50. Because the edge of the work piece that is resting against the fence is being removed by the router cutter 118, the work piece will tend to move inward toward the fence, when using prior art pusher devices, as the complete profile of the edge of the material is being removed downstream from the cutter. The work piece drops in toward the fence as the work piece exits the router cutter 118 by the amount of the material being removed, thus creating a two steps profile referred to as a snipe. The present invention overcomes this problem because it slides along the fence during use and thereby secures the work piece in its original position relative to the fence as the cut is made; preventing the work piece from sliding toward the fence downstream of the cutter.

The bridge handle 202 includes a handle portion 204, which may be grasped by a user, and a bridge portion 206 connected between the handle portion 204 and the body 52 of the apparatus 200. The bridge portion 206 includes an undercut center section 208 that allows the bridge portion 206 to connect to the body 52 on opposed sides of the body 52 proximate the inside cut leg 56 and the outside cut leg 58 respectively. The bridge handle 202 of FIG. 13 contacts the body 52 at four locations; two on each side of the body 52 on both the forward and rearward ends of the apparatus 200. Note that the apparatus 200 of FIG. 13 is symmetric about a longitudinal axis parallel to the cut line, therefore, either end may be used as the forward or rearward end and either leg may be used as the inside cut leg or the outside cut leg.

Figure 14:
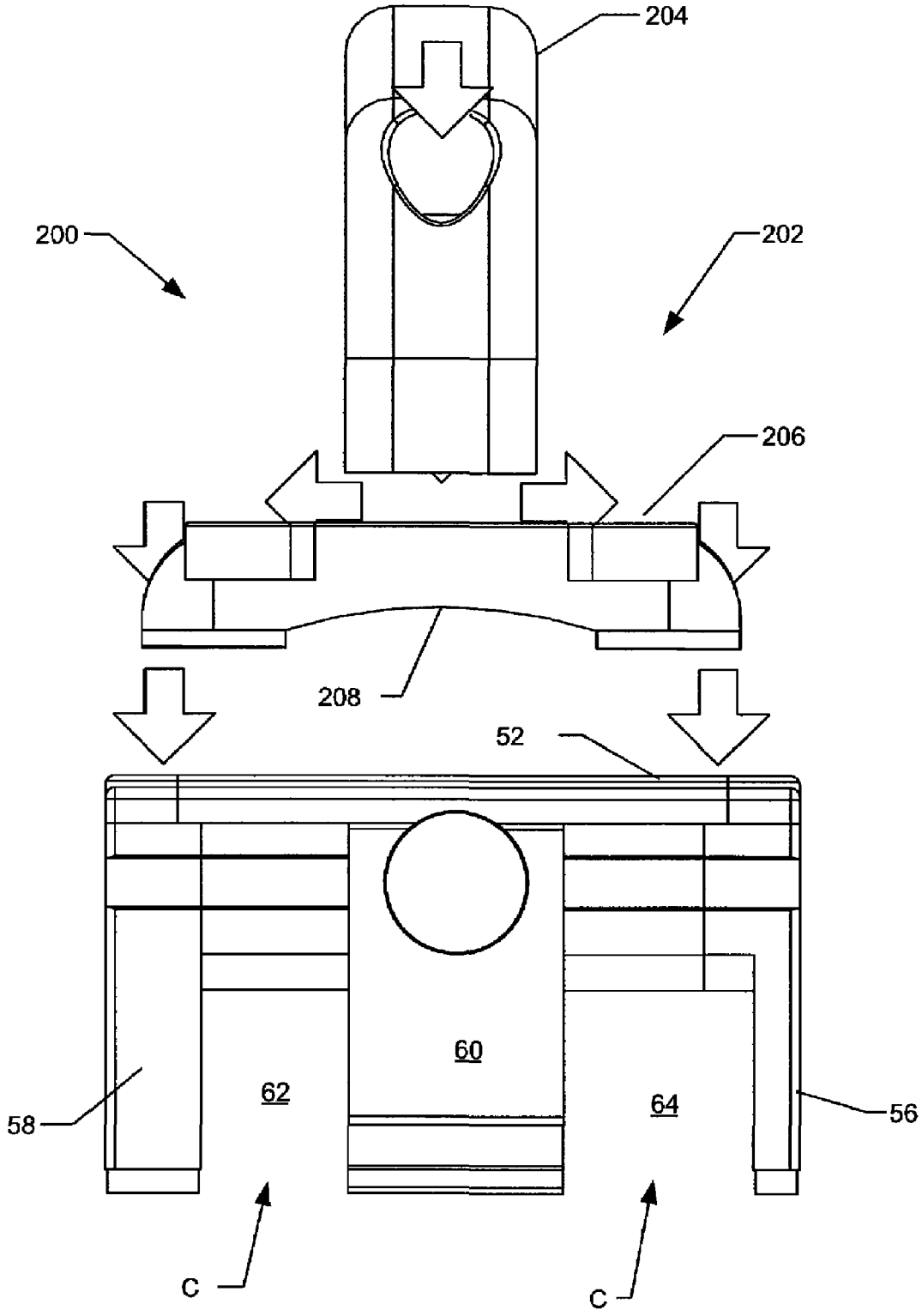
FIG. 14 is a schematic illustration of the force path through the bridge handle of the apparatus of FIG. 13.

FIG. 14 illustrates how the bridge portion 206 functions to transfer into the body 52 those forces that are exerted onto the handle portion 204 by the user to balance the transfer of force into the inside cut portion and the outside cut portion through the inside cut leg and outside cut leg respectively. As illustrated by the arrows, the forces flow from the handle portion 204 into the bridge portion 206 and then into the body 52 on opposed sides of a cut line C that may extend through either of the tunnels 62, 64. This geometry ensures that both the inside cut portion and outside cut portion of a work piece are properly controlled by balanced loads as they pass through the saw blade, even if the handle portion 204 is not centered over the cut line C and even if the cut line C is not centered under the apparatus 200. Thus, it is not necessary to adjust the position of the handle of pusher apparatus 200 each time a different type/size of cut is made, as may be done with the embodiment of FIG. 2. This feature is especially advantageous when only a small width of material is being removed from a work piece by a saw cut and the cut line C is located very close to one of the two side legs 56, 58.

Handle portion 204 and bridge portion 206 of bridge handle 202 may be formed as an integral unit. Alternatively, as illustrated in FIG. 13, handle portion 204 may be formed separately and joined to bridge portion 206 by hardware (not shown) that passes through respective slots 210 formed through the bridge portion 208 in order to provide a degree of adjustability in the position of the handle portion 204 relative to the bridge portion 208 and body 52. In particular, it may be advantageous to align a longitudinal axis of the handle portion 204 at an angle relative to a longitudinal axis of the body 52 and the cut line C, as illustrated in FIG. 13. The result of this geometry is that when the user pushes downward and forward on handle portion 204 to move a work piece through a table saw blade, a portion of the force is vectored toward the table saw fence to urge the apparatus 200 against the fence into its proper position. Note that while the pusher apparatus 200 is thus held against the fence, and it in turn holds the inside cut portion of the work piece against the fence as it is moved through the saw blade, the geometry of the apparatus 200 precludes the exertion of any force onto the outside cut portion in a direction toward the cut line C. As described above, any such lateral force on the outside cut portion could cause an unsafe condition resulting from binding of the saw blade. The angled handle portion 204 helps to ensure that the apparatus 200 and work piece are held against the fence while eliminating any possibility of lateral force being applied to the outside cut portion. This is because the portion of the force that is vectored toward the fence is transferred through the body 52 into the fence without creating any lateral movement of the leg of the apparatus 200 that is in contact with the outside cut portion of the work piece. Thus, safe movement of the work piece through the saw blade is accomplished.

Figure 15:
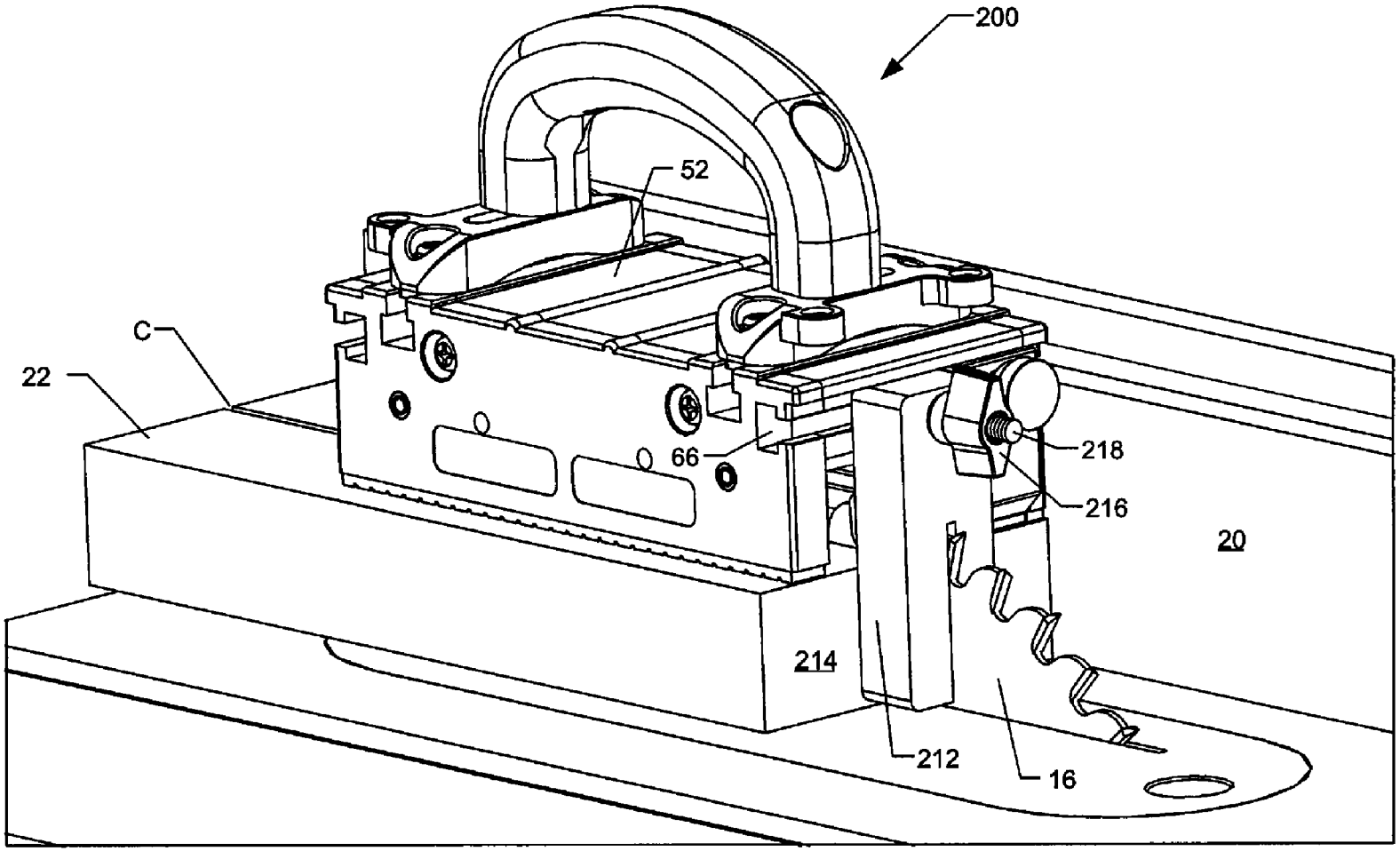
FIG. 15 is a perspective view of the apparatus of FIG. 13 being used on a table saw with a trailing edge heel device.

FIG. 15 illustrates the pusher apparatus 200 being used with a trailing edge heel 212. The heel 212 is abutted against the rearmost surface 214 of the work piece 22 and provides two functions. First, heel 212 provides an addition location for transferring forward motion force into the work piece 22. Second, heel 212 also helps to prevent splintering of the rearmost surface 214 of the work piece 22 on either side of the cut line C, also known as blowout. Blowout is common when cutting across the grain of wood due to mechanical failure (splintering) of the outermost layer(s) of the work piece caused by the force being exerted on the ever-thinning edge of the work piece as the saw blade moves toward the rearmost surface 214. The heel 212 exerts a compressive force on the rearmost surface 214 that tends to minimize or eliminate such blowout. The heel 212 may be made of wood, plastic or other relatively stiff but soft material and may be considered a consumable item, since it may be cut by the saw blade 16 as the work piece is moved completely past the blade, as illustrated in FIG. 15. In one embodiment, the heel may be held in place behind tunnel 62 or 64 with a wing nut 216 that is threaded onto a bolt 218 that is slidably associated with keyway 66 so that the heel 212 may be moved to any position along the rear of the apparatus 200 and then secured in that position by tightening the wing nut 216. Alternatively, a thumbscrew (not shown) may thread into a nut attached to the middle leg 60 or elsewhere on the body 52 of the pusher apparatus 200 in other embodiments.

Figure 16:
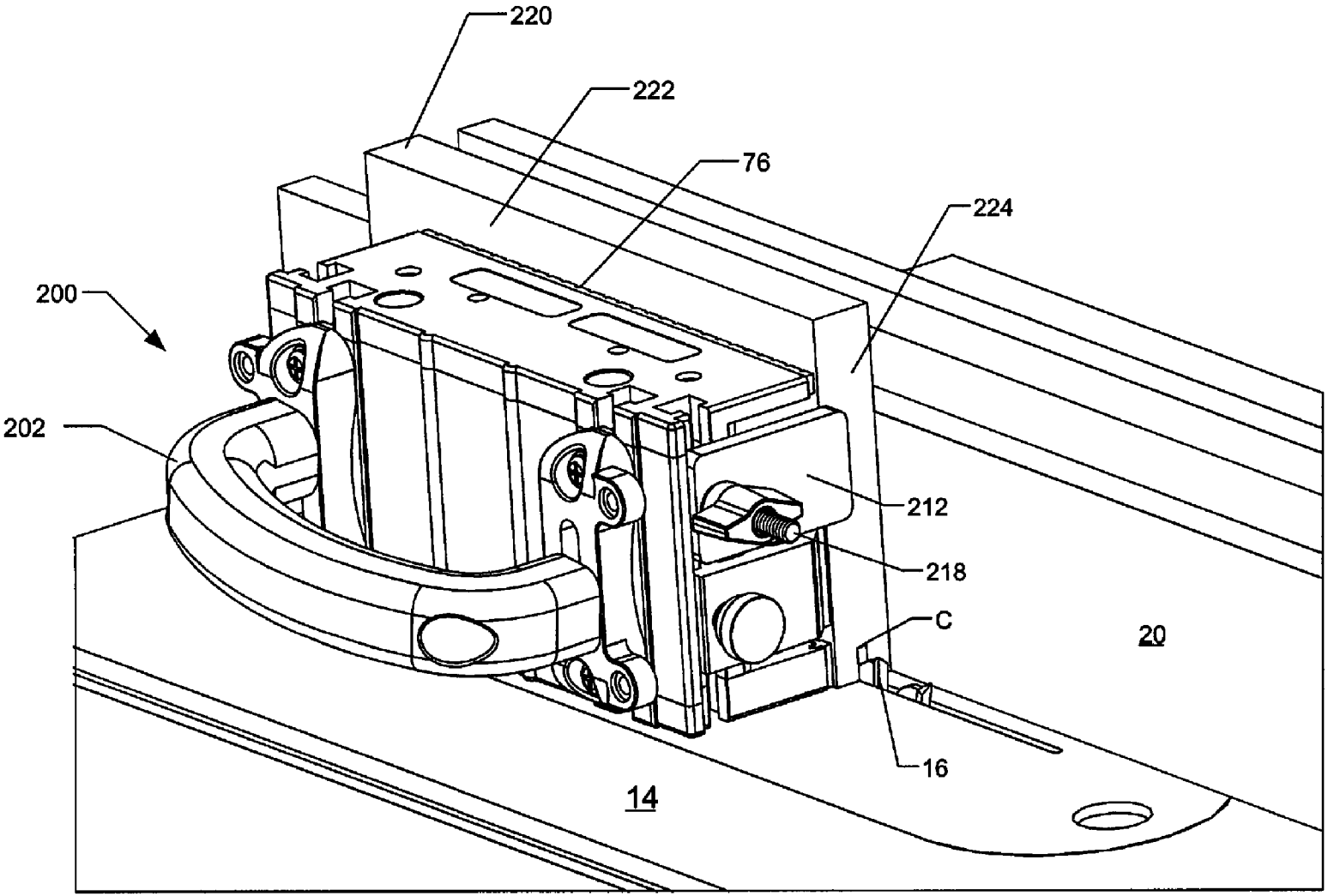
FIG. 16 is a perspective view of the apparatus of FIG. 13 being used on a table saw in a vertical position.

FIG. 16 illustrates apparatus 200 being used in an alternative manner for urging a work piece 220 through a saw blade 16. In this embodiment, the work piece 220 is positioned with its wide surface against the guide fence 20 so that a cut can be made along its more narrow side surface. The work piece contacting surfaces 76 are placed against a wide surface 222 of the work piece opposed the fence 20 to urge the work piece 220 against the fence 20 and through the saw blade 16 when the handle 202 is grasped by a user. The leg side surface of the apparatus 200 that would normally slide along the fence 20 is positioned to slide along the saw table surface 14. A trailing edge heel 212 may be positioned to engage a rear surface 224 of the work piece 220 at a location above the cut line C. In this manner of use the cut line C does not pass through either of the tunnels defined by the apparatus 200; however, the apparatus 200 still functions to provide safe and secure movement of the work piece 220 through the saw blade 16.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

The invention claimed is:

1. An apparatus for guiding a work piece through a blade of a table saw to create a cut line defining an inside cut portion and an outside cut portion of the work piece, the apparatus comprising:

a body;

an inside cut leg extending from the body to make frictional contact with a top surface of the inside cut portion of the work piece;

an outside cut leg extending from the body to make frictional contact with a top surface of the outside cut portion of the work piece; and a handle adapted to be grasped by a user of the apparatus while guiding the work piece through the blade of the table saw, the handle attached to the body on opposed sides of the body proximate the inside cut leg and the outside cut leg respectively to balance a transfer of force exerted by the user through the inside cut leg and outside cut leg onto the top surface of the inside cut portion and the top surface of the outside cut portion respectively for control of both the inside cut portion and the outside cut portion as the work piece is moved through the blade of the table saw;

wherein the handle further comprises:

a handle portion which may be grasped by the user; and a bridge portion connected between the handle portion and the opposed sides of the body;

wherein the bridge portion comprises an undercut center section allowing the bridge portion to connect to the body on the opposed sides of the body.

2. The apparatus of claim 1, wherein the bridge portion contacts the body at four locations; two on each side of the body on both forward and rearward ends of the body.

3. The apparatus of claim 1, wherein the handle portion is adjustably joined to the bridge portion in order to provide a degree of adjustability in positioning the handle portion relative to the bridge portion and body.

4. An apparatus for guiding a work piece through a blade of a table saw to create a cut line defining an inside cut portion and an outside cut portion of the work piece, the apparatus comprising:

a first means for exerting controlling downward and forward directed forces on the inside cut portion of the work piece and for resisting movement of the inside cut portion in a direction not parallel to a guide surface of the table saw;

a second means for exerting controlling downward and forward directed forces on the outside cut portion of the work piece and for resisting movement of the outside cut portion in a direction not parallel to the guide surface of the table saw;

a means for adjusting a space between the first and second means to accommodate a plurality of locations of the cut line on the work piece; and a means for applying balanced forces on the first and second means simultaneously to control movement of the work piece from a location before it makes contact with the blade, through a location where it is being cut by the blade, to a position after being cut by the blade into the inside cut portion and outside cut portion;

wherein the means for applying balanced forces comprises a bridge handle attached to a body of the apparatus; and wherein the bridge handle comprises a handle portion disposed at a selectable angle relative to a longitudinal axis of the body so that the a longitudinal axis of the handle portion may be disposed parallel to the cut line or not parallel to the cut line.

5. An apparatus for guiding work piece through a blade of a table saw to create a cut line defining an inside cut portion and an outside cut portion of the work piece, the apparatus comprising:

a first means for exerting controlling downward and forward directed forces on the inside cut portion of the work piece and for resisting movement of the inside cut portion in a direction not parallel to a guide surface of the table saw;

a second means for exerting controlling downward and forward directed forces on the outside cut portion of the work piece and for resisting movement of the outside cut portion in a direction not parallel to the guide surface of the table saw;

a means for adjusting a space between the first and second means to accommodate a plurality of locations of the cut line on the work piece; and a means for applying balanced forces on the first and second means simultaneously to control movement of the work piece from a location before it makes contact with the blade, through a location where it is being cut by the blade, to a position after being cut by the blade into the inside cut portion and outside cut portion;

further comprising a trailing heel adjustably attached to a body of the apparatus at any of a plurality of positions for abutting a rearmost surface of the work piece.

6. An apparatus for guiding a work piece through a blade of a table saw to create a cut line defining an inside cut portion and an outside cut portion of the work piece, the apparatus comprising:

a first means for exerting controlling downward and forward directed forces on the inside cut portion of the work piece and for resisting movement of the inside cut portion in a direction not parallel to a guide surface of the table saw;

a second means for exerting controlling downward and forward directed forces on the outside cut portion of the work piece and for resisting movement of the outside cut portion in a direction not parallel to the guide surface of the table saw;

a means for adjusting a space between the first and second means to accommodate a plurality of locations of the cut line on the work piece; and a means for applying balanced forces on the first and second means simultaneously to control movement of the work piece from a location before it makes contact with the blade, through a location where it is being cut by the blade, to a position after being cut by the blade into the inside cut portion and outside cut portion; further comprising:

the first means comprises a first leg extending downward from a body of the apparatus to a first non-slip work piece contacting surface;

the second means comprises a second leg extending downward from the body of the apparatus to a second non-slip work piece contacting surface; and the means for adjusting a space between the first and second means comprises a center leg extending downward from the body of the apparatus to a third non-slip work piece contacting surface, the position of the center leg being adjustably fixable at a plurality of positions between the first leg and the second leg.

* * * * *